US009194393B2

(12) United States Patent
Pham

(10) Patent No.: US 9,194,393 B2
(45) Date of Patent: Nov. 24, 2015

(54) COMPRESSOR WITH FLOODED START CONTROL

(71) Applicant: Emerson Climate Technologies, Inc., Sidney, OH (US)

(72) Inventor: Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 7 days.

(21) Appl. No.: 14/250,704

(22) Filed: Apr. 11, 2014

(65) Prior Publication Data

US 2014/0308138 A1 Oct. 16, 2014

Related U.S. Application Data

(60) Provisional application No. 61/811,440, filed on Apr. 12, 2013.

(51) Int. Cl.

| | |
|---|---|
| ***F04C 28/06*** | (2006.01) |
| ***F04B 49/02*** | (2006.01) |
| ***F04B 49/20*** | (2006.01) |
| ***F04C 18/02*** | (2006.01) |
| *F25B 43/00* | (2006.01) |

(52) U.S. Cl.

CPC ..... *F04C 28/06* (2013.01); *F04B 49/02* (2013.01); *F04B 49/20* (2013.01); *F04C 18/0215* (2013.01); *F04C 2240/81* (2013.01); *F04C 2270/19* (2013.01); *F25B 43/00* (2013.01)

(58) Field of Classification Search

CPC ..... F25B 43/00; F04B 49/02; F04B 49/20

See application file for complete search history.

(56) References Cited

U.S. PATENT DOCUMENTS

| | | | |
|---|---|---|---|
| 6,539,734 | B1 | 4/2003 | Weyna |
| 6,578,373 | B1 | 6/2003 | Barbier |

(Continued)

FOREIGN PATENT DOCUMENTS

| | | | |
|---|---|---|---|
| JP | 2001123954 | A | 5/2001 |
| JP | 2011145017 | A | 7/2011 |

(Continued)

OTHER PUBLICATIONS

International Search Report regarding Application No. PCT/US2014/033803, mailed Aug. 12, 2014.

Written Opinion of the International Searching Authority regarding Application No. PCT/US2014/033803, mailed Aug. 12, 2014.

*Primary Examiner* — Nathan J Newhouse

*Assistant Examiner* — Christopher Bobish

(74) *Attorney, Agent, or Firm* — Harness, Dickey & Pierce, P.L.C.

(57) ABSTRACT

A system and method for flooded start control of a compressor for a refrigeration system is provided. A temperature sensor generates temperature data corresponding to at least one of a compressor temperature and an ambient temperature. A control module receives the temperature data, determines an off-time period since the compressor was last on, determines an amount of liquid present in the compressor based on the temperature data and the off-time period, compares the amount of liquid with a predetermined threshold, and, when the amount of liquid is greater than the predetermined threshold, operates the compressor according to at least one cycle including a first time period during which the compressor is on and a second time period during which the compressor is off.

20 Claims, 20 Drawing Sheets

(56) References Cited

U.S. PATENT DOCUMENTS

| | | | | |
|---|---|---|---|---|
| 6,748,753 | B2 | 6/2004 | Takano et al. | |
| 7,878,006 | B2 | 2/2011 | Pham | |
| 2004/0194485 | A1 | 10/2004 | Dudley | |
| 2006/0179855 | A1 * | 8/2006 | Lifson et al. | 62/160 |
| 2009/0324427 | A1 | 12/2009 | Tolbert, Jr. et al. | |
| 2010/0178175 | A1 | 7/2010 | Koyama | |
| 2015/0007597 | A1 | 1/2015 | Senf, Jr. | |

FOREIGN PATENT DOCUMENTS

| | | | |
|---|---|---|---|
| WO | 2007106116 | A1 | 9/2007 |
| WO | WO-2008033123 | A1 | 3/2008 |
| WO | 2013134240 | A1 | 9/2013 |

* cited by examiner

COMPRESSOR WITH FLOODED START CONTROL

CROSS-REFERENCE TO RELATED APPLICATIONS

This application claims the benefit of U.S. Provisional Application No. 61/811,440, filed on Apr. 12, 2013. The entire disclosure of the above application is incorporated herein by reference.

FIELD

The present disclosure relates to compressor control and, more specifically, to a system and method for flooded start control of a compressor.

BACKGROUND

This section provides background information related to the present disclosure which is not necessarily prior art.

Compressors are used in a wide variety of industrial and residential applications to circulate refrigerant within refrigeration, HVAC, heat pump, or chiller systems (generally referred to as "refrigeration systems") to provide a desired heating or cooling effect. In any of these applications, the compressor should provide consistent and efficient operation to ensure that the particular refrigeration system functions properly.

The compressor may include a crankcase to house moving parts of the compressor, such as a crankshaft. In the case of a scroll compressor, the crankshaft drives an orbiting scroll member of a scroll set, which also includes a stationary scroll member. The crankcase may include a lubricant sump, such as an oil reservoir. The lubricant sump can collect lubricant that lubricates the moving parts of the compressor.

When the compressor is off, liquid refrigerant in the refrigeration system generally migrates to the coldest component in the system. For example, in an HVAC system, during an overnight period of a diurnal cycle when the HVAC system is off, the compressor may become the coldest component in the system and liquid refrigerant from throughout the system may migrate to, and collect in, the compressor. In such case, the compressor may gradually fill with liquid refrigerant and become flooded.

One issue with liquid refrigerant flooding the compressor is that the compressor lubricant is generally soluble with the liquid refrigerant. As such, when the compressor is flooded with liquid refrigerant, the lubricant normally present in the lubricant sump can dissolve in the liquid refrigerant, resulting in a liquid mixture of refrigerant and lubricant.

Further, in an HVAC system, upon startup in the morning of a diurnal cycle, the compressor may begin operation in a flooded state. In such case, the compressor may quickly pump out all of the liquid refrigerant, along with all of the dissolved lubricant, in the compressor. For example, the compressor may pump all of the liquid refrigerant and dissolved lubricant out of the compressor in less than ten seconds. At this point, the compressor may continue to operate without lubrication, or with very little lubrication, until the refrigerant and lubricant returns to the suction inlet of the compressor after being pumped through the refrigeration system. For example, it may take up to one minute, depending on the size of the refrigeration system and the flow control device used in the refrigeration system, for the lubricant to return to the compressor. Operation of the compressor without lubrication, however, can damage the internal moving parts of the compressor, result in compressor malfunction, and reduce the reliability and useful life of the compressor. For example, operation of the compressor without lubrication can result in premature wear to the compressor bearings.

Traditionally, crankcase heaters have been used to heat the crankcase of the compressor to prevent or reduce liquid migration to the compressor and a flooded compressor state. Crankcase heaters, however, increase energy costs as electrical energy is consumed to heat the compressor. Additionally, while crankcase heaters can be effective for slow rates of liquid migration, crankcase heaters can be less effective for fast rates of liquid migration, depending on the size or heating capacity of the crankcase heater.

SUMMARY

This section provides a general summary of the disclosure, and is not a comprehensive disclosure of its full scope or all of its features.

A system for flooded start control is provided and includes a compressor for a refrigeration system and a temperature sensor that generates temperature data corresponding to at least one of a compressor temperature and an ambient temperature. The control module receives the temperature data, determines an off-time period since the compressor was last on, determines an amount of liquid present in the compressor based on the temperature data and the off-time period, compares the amount of liquid with a predetermined threshold, and, when the amount of liquid is greater than the predetermined threshold, operates the compressor according to at least one cycle including a first time period during which the compressor is on and a second time period during which the compressor is off.

A method for flooded start control is provided and includes generating temperature data with a temperature sensor, the temperature data corresponding to at least one of a compressor temperature and an ambient temperature. The method also includes receiving the temperature data with a control module. The method also includes determining, with the control module, an off-time period since the compressor was last on. The method also includes determining, with the control module, an amount of liquid present in the compressor based on the temperature data and the off-time period. The method also includes comparing, with the control module, the amount of liquid with a predetermined threshold. The method also includes operating, with the control module, the compressor according to at least one cycle including a first time period during which the compressor is on and a second time period during which the compressor is off when the amount of liquid is greater than the predetermined threshold.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

In the drawings, reference numbers may be reused to identify similar and/or identical elements.

DETAILED DESCRIPTION

Figure 1A:
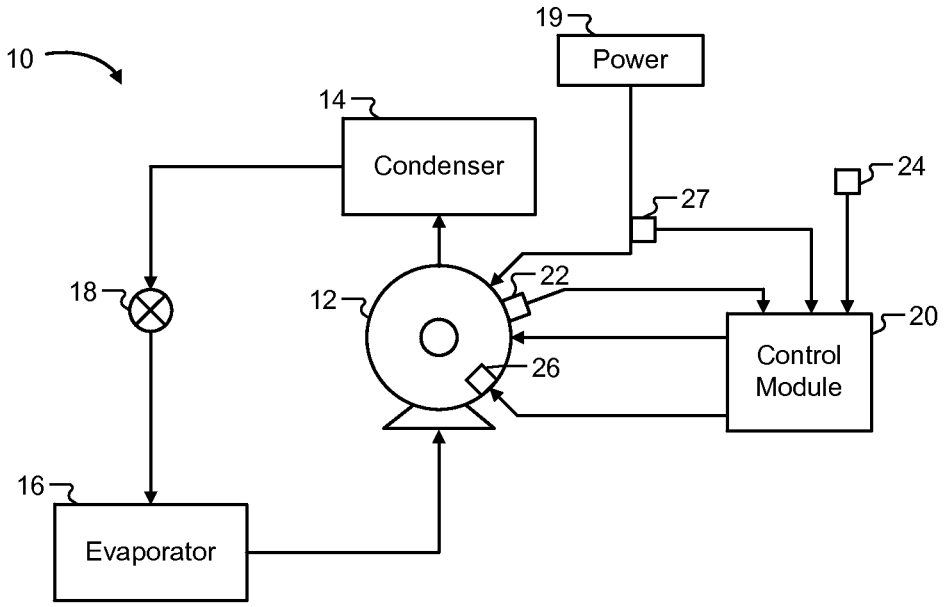
FIG. 1A is a functional block diagram of an example system according to the present disclosure.

Example embodiments will now be described more fully with reference to the accompanying drawings.

The present disclosure relates to a system and method for starting a compressor while in a flooded state. More specifically, instead of quickly pumping out all of the liquid refrigerant and dissolved lubricant present in the compressor when in a flooded state, the flooded start control of the present disclosure provides for cycling the compressor with one or more short on/off cycles to gradually pump liquid from the compressor without completely emptying the compressor of liquid refrigerant and lubricant. In this way, more time is allowed for the refrigerant/lubricant to work through the refrigeration system and return to the compressor before the compressor is emptied of liquid. Further, the gradual pumping of liquid from the compressor allows more time for the compressor to heat up on its own due to operation of the electric motor in the compressor and due to the rotation of the internal moving parts of the compressor, such as the crank shaft and compression mechanism. Additionally, as the pressure within the suction chamber of the compressor decreases and the temperature within the suction chamber of the compressor increases due to operation of the compressor, the liquid refrigerant within the compressor can start to flash to gaseous refrigerant that is then pumped out of the system, leaving lubricant behind in the compressor.

In this way, utilizing a flooded start control with one or more on/off cycles to begin operation of the compressor in a flooded state can more efficiently and effectively handle and manage the liquid refrigerant and lubricant in the compressor, resulting in improved operation of the compressor. Additionally, utilizing a flooded start control with one or more on/off cycles to begin operation of the compressor in a flooded state can decrease the need for use of a crankcase heater, resulting in lower energy consumption costs. In some instances, a smaller more energy efficient crankcase heater can be used. In other instances, the need for a crankcase heater can be eliminated altogether.

As discussed in further detail below, the present disclosure includes systems and methods for detecting when to utilize a flooded start control. For example, the present disclosure includes determining an amount of liquid migration to the compressor and comparing the determined amount with a threshold to determine if the compressor is in a flooded state.

Additionally, the present disclosure includes systems and methods for implementing a flooded start control by utilizing one or more on/off cycles to begin operation of the compressor in a flooded state. For example, the compressor may be started with one or more cycles that include a two-second on-period followed by a five-second off-period per cycle. The present disclosure includes determining the on-period, the off-period, and the number of cycles to be utilized.

Additionally, the present disclosure includes systems and methods for optimizing the flooded start control based on the types of components and specific configuration and operating characteristics of the particular refrigeration system.

With reference to FIG. 1A, a refrigeration system 10 is shown and includes a compressor 12, a condenser 14, an evaporator 16, and a flow control device 18. The refrigeration system 10, for example, may be an HVAC system, with the evaporator 16 located indoors and the compressor 12 and condenser 14 located in a condensing unit outdoors. The flow control device 18 may be a capillary tube, a thermal expansion valve (TXV), or an electronic expansion valve (EXV). The compressor 12 is connected to a power supply 19.

A control module 20 controls the compressor 12 by turning the compressor 12 on and off. More specifically, the control module 20 controls a compressor contactor 40 (shown in FIG. 3) that connects or disconnects an electric motor 42 (shown in FIG. 3) of the compressor 12 to the power supply 19.

With reference again to FIG. 1A, the control module 20 may be in communication with a number of sensors. For example, the control module 20 may receive outdoor ambient temperature data from an outdoor ambient temperature sensor 24 that may be located outdoors near the compressor 12 and condenser 14 to provide data related to the ambient outdoor temperature. The outdoor ambient temperature sensor 24 may also be located in the immediate vicinity of the compressor 12 to provide data related to the temperature at a location in the immediate vicinity of the compressor 12. Alternatively, the control module 20 may receive the outdoor ambient temperature data through communication with a thermostat, or remote computing device, such as a remote server, that monitors and stores outdoor ambient temperature data. Additionally, the control module 20 may receive compressor temperature data from a compressor temperature sensor 22 attached to and/or located within the compressor 12. For example, the compressor temperature sensor 22 may be located at a lower portion of the compressor 12 due to any liquid refrigerant being located near the bottom of the compressor due to gravity and density. Additionally, the control module 20 may receive electrical current data from a current sensor 27 connected to a power input line between the power supply 19 and the compressor 12. The electrical current data may indicate an amount of current flowing to the compressor 12 when the compressor is operating. Alternatively, a voltage sensor or power sensor may be used in addition to, or in place of, the current sensor 27. Other temperature sensors may be used. For example, alternatively, a motor temperature sensor may be used as the compressor temperature sensor 22.

The control module 20 may also control a crankcase heater 26 attached to or located within the compressor 12. For example, the control module 20 may turn the crankcase heater 26 on and off, as appropriate, to provide heat to the compressor and, more specifically, to the crankcase of the compressor.

The control module 20 may be located at or near the compressor 12 at the condensing unit that houses the compressor 12 and condenser 14. In such case, the compressor 12 may be located outdoors. Alternatively, the compressor 12 may be located indoors and inside a building associated with the refrigeration system. Alternatively, the control module 20 may be located at another location near the refrigeration system 10. For example, the control module 20 may be located indoors. Alternatively, the functionality of the control module 20 may be implemented in a refrigeration system controller. Alternatively, the functionality of the control module 20 may be implemented in a thermostat located inside a building associated with the refrigeration system 10. Alternatively, the functionality of the control module 20 may be implemented at a remote computing device.

Figure 1B:
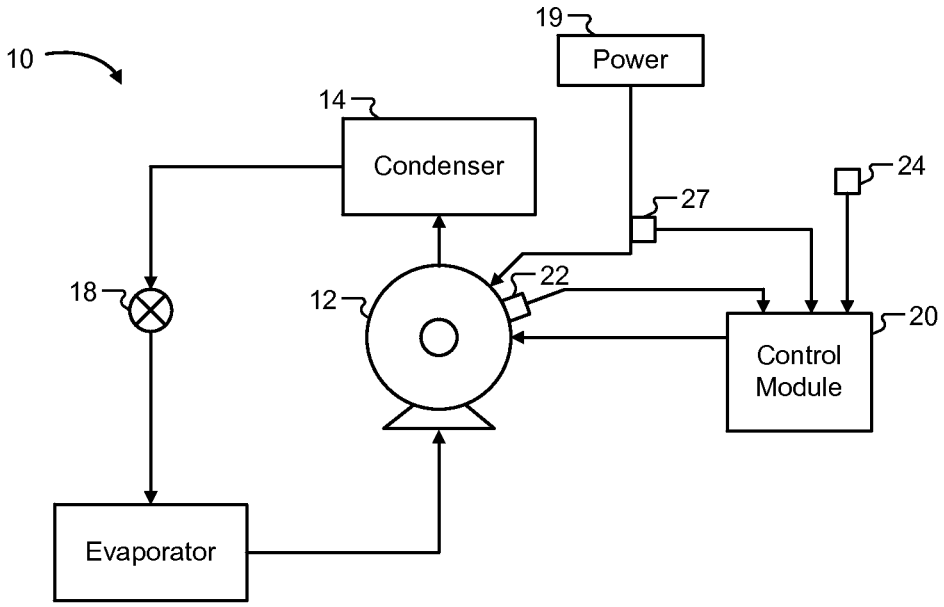
FIG. 1B is a functional block diagram of another example system according to the present disclosure.

With reference to FIG. 1B, another refrigeration system 10 is shown. The refrigeration system 10 of FIG. 1B is similar to the refrigeration system 10 of FIG. 1A except that the compressor 12 of the refrigeration system 10 of FIG. 1B does not include a crankcase heater 26. As described in further detail below, the flooded start control of the present disclosure may be used for compressors 12 both with and without crankcase heaters 26.

Figure 2A:
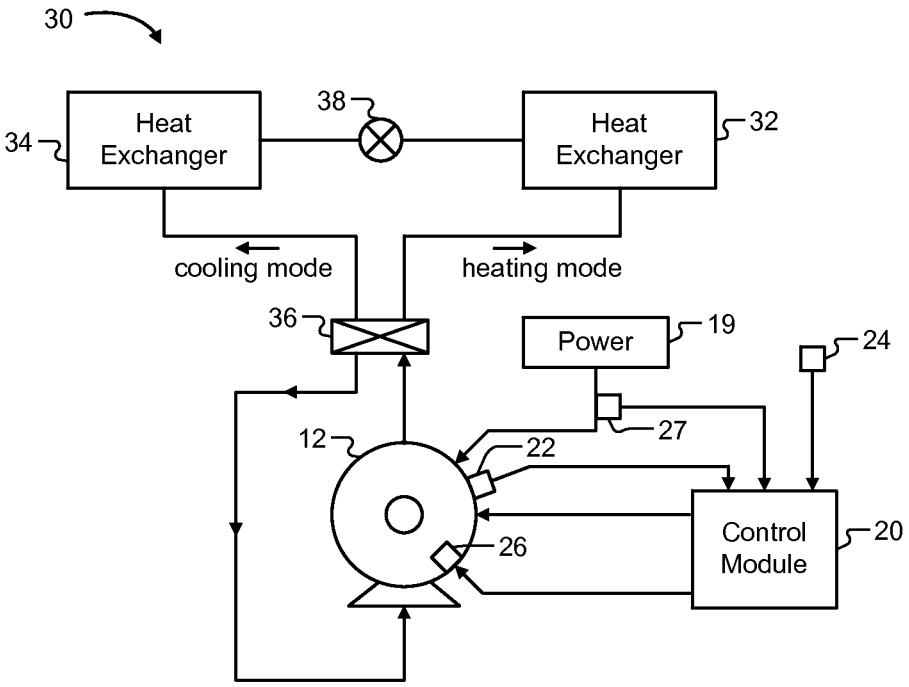
FIG. 2A is a functional block diagram of another example system according to the present disclosure.

With reference to FIG. 2A, another refrigeration system 30 is shown. Refrigeration system 30 is a reversible heat pump system, operable in both a cooling mode and a heating mode. The refrigeration system 30 is similar to the refrigeration systems 10 shown in FIGS. 1A and 1B, except that the refrigeration system 30 includes a four-way reversing valve 36. Further, the refrigeration system 30 includes an indoor heat exchanger 32 and an outdoor heat exchanger 34. In the cooling mode, refrigerant discharged from the compressor 12 is routed by the four-way valve 36 to the outdoor heat exchanger 34, through a flow control device 38, to the indoor heat exchanger 32, and back to a suction side of the compressor 12. In the heating mode, refrigerant discharged from the compressor 12 is routed by the four-way valve 36 to the indoor heat exchanger 32, through the flow control device 38, to the outdoor heat exchanger 34, and back to the suction side of the compressor 12. In a reversible heat pump system, the flow control device 38 may include an expansion device, such as a thermal expansion device (TXV) or electronic expansion device (EXV). Optionally, the flow control device 38 may include a plurality of flow control devices 38 arranged in parallel with a bypass that includes a check valve. In this way, the flow control device 38 may properly function in both the cooling mode and in the heating mode of the heat pump system. Other components of the refrigeration system 30 are the same as those described above with respect to FIG. 1A and their description is not repeated here.

Figure 2B:
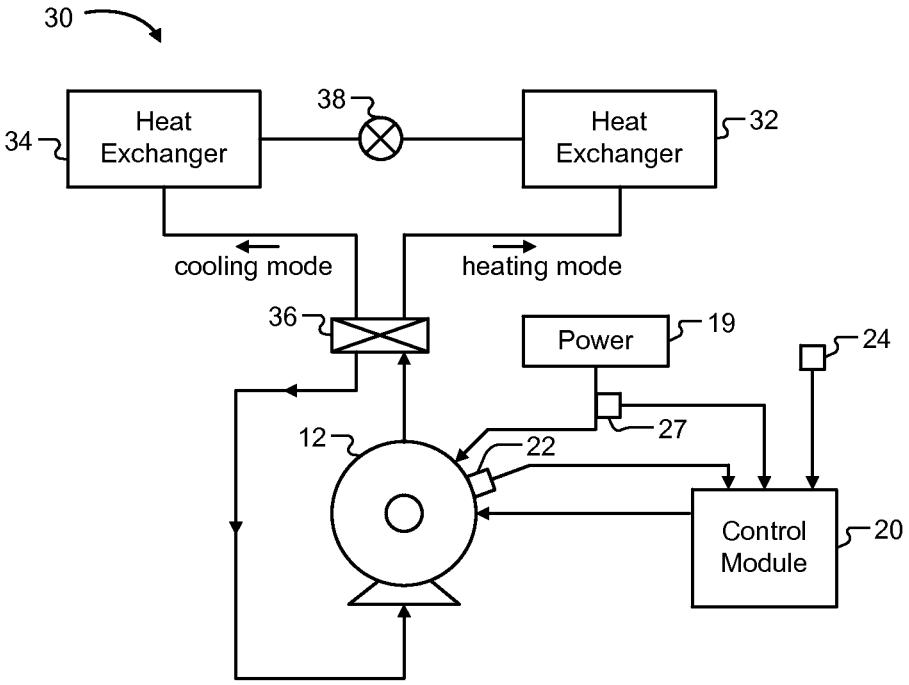
FIG. 2B is a functional block diagram of another example system according to the present disclosure.

With reference to FIG. 2B, another refrigeration system 30 is shown. The refrigeration system 30 of FIG. 2B is similar to the refrigeration system 30 of FIG. 2A except that the compressor 12 of the refrigeration system 30 of FIG. 2B does not include a crankcase heater 26. As described in further detail below, the flooded start control of the present disclosure may be used for compressors 12 both with and without crankcase heaters 26.

Figure 3:
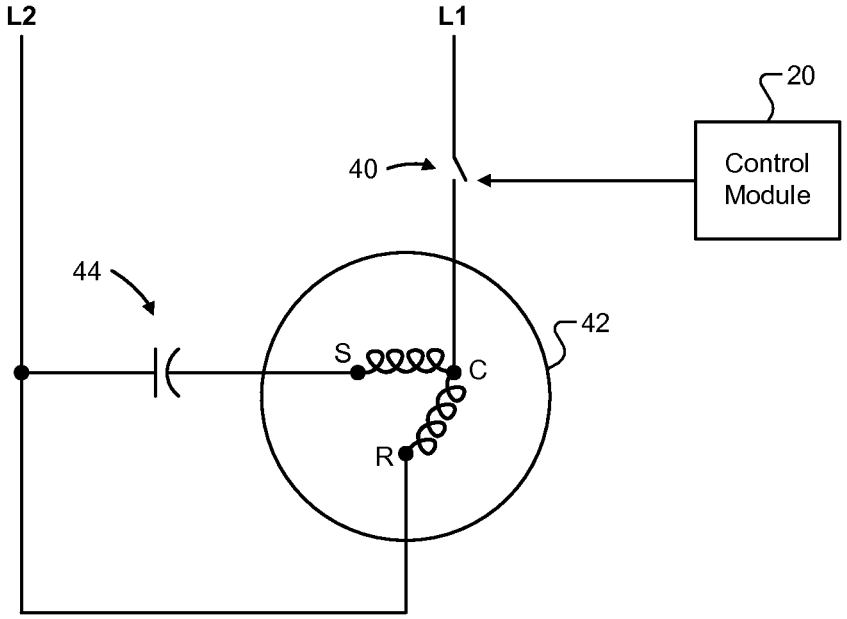
FIG. 3 is a functional block diagram of an example compressor motor according to the present disclosure.

With reference to FIG. 3, an electric motor 42 of the compressor 12 is shown. As shown, a first electrical terminal (L1) is connected to a common node (C) of the electric motor 42. A start winding is connected between the common node (C) and a start node (S). A run winding is connected between the common node (C) and a run node (R). The start node (S) and the run node (R) are each connected to a second electrical terminal (L2). A run capacitor 44 is electrically coupled in series with the start winding between the start node (S) and the second electrical terminal (L2).

The control module 20 turns the electric motor 42 of the compressor on and off by opening and closing the compressor contactor 40 that connects or disconnects the common node (C) of the electric motor 42 to electrical terminal (L1).

Figure 4:
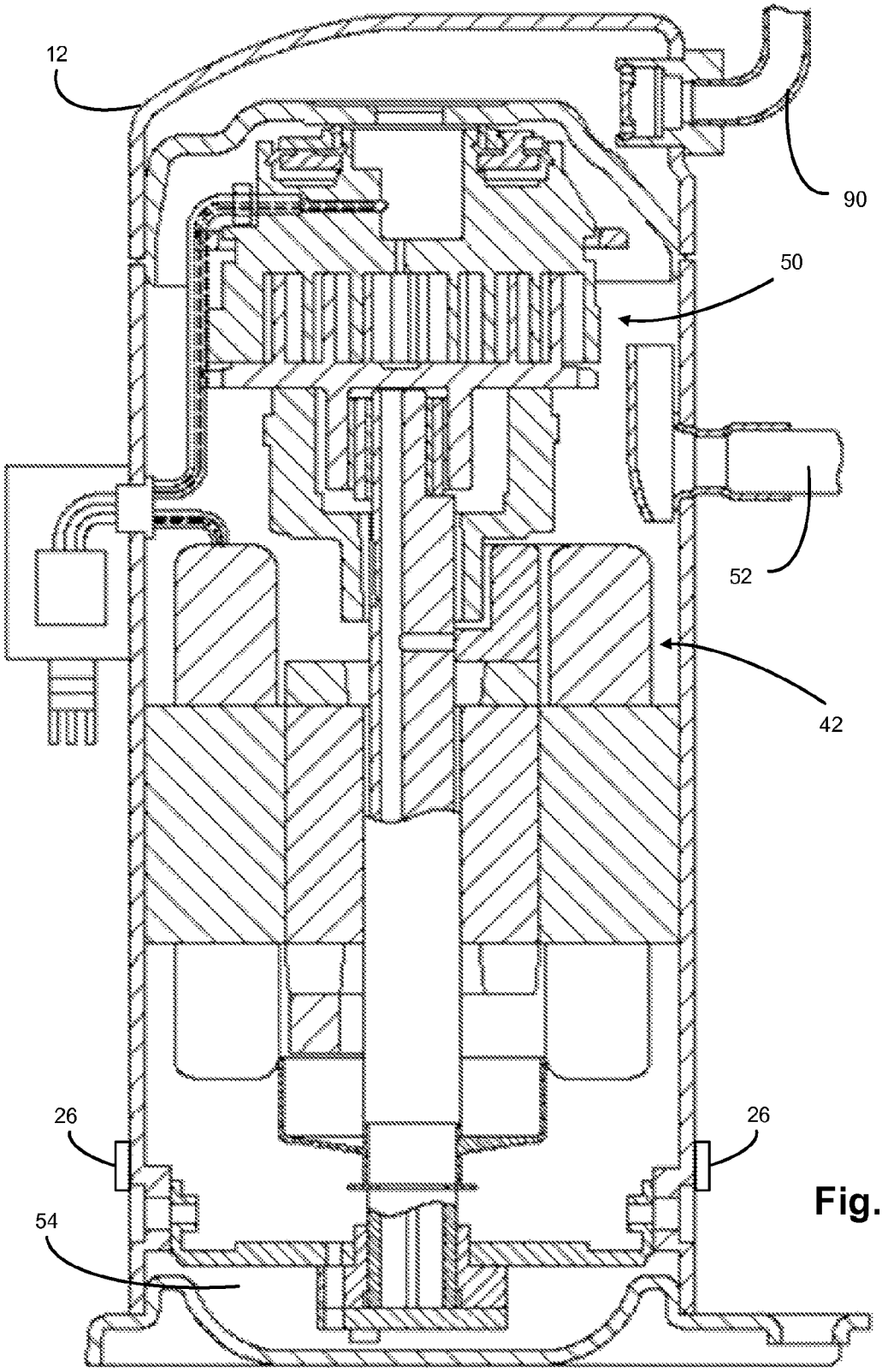
FIG. 4 is a cross-sectional view of an example compressor according to the present disclosure.

With reference to FIG. 4, a cross-section of a low-side scroll compressor 12 is shown and includes a scroll set 50, with an orbiting scroll member driven by a crankshaft, which, in turn, is driven by electric motor 42. The scroll set 50 also includes a stationary scroll member. A crankcase of the compressor 12 includes a lubricant sump 54, such as an oil reservoir. The compressor 12 includes a crankcase heater 26, which, in this case, is a bellyband type crankcase heater 26 located on an exterior of a shell of the compressor 12 and encircling the compressor 12. Other types of crankcase heaters 26, however, may be used, including crankcase heaters 26 that are internal to the compressor and crankcase heaters 26 that utilize the stator of the electric motor 42 as a crankcase heater. The compressor 12 also includes a suction inlet 52 and a discharge outlet 90. While a low-side scroll compressor 12 is shown as an example in FIG. 4, the present disclosure may be used with other types of compressors as well, including, for example, reciprocating or rotary type compressors, and/or directed suction type compressors, as described in further detail below.

Figure 5:
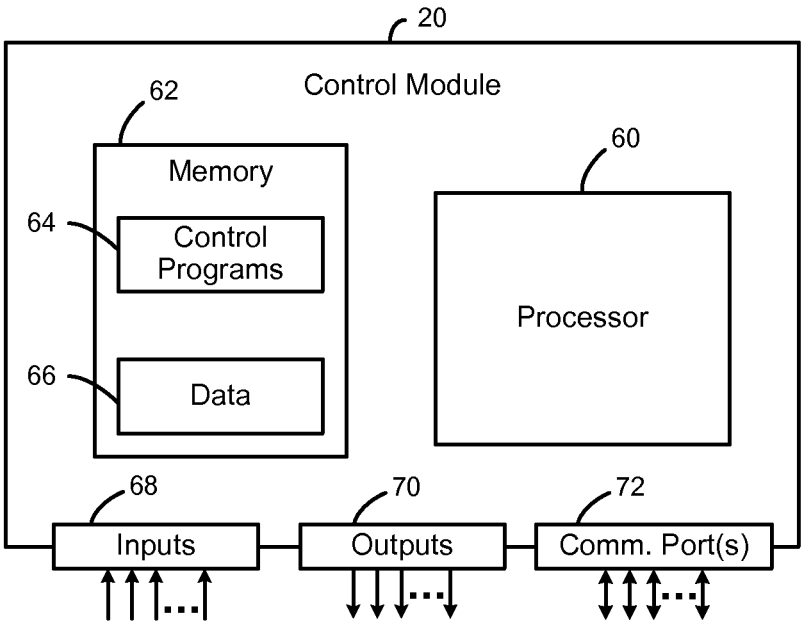
FIG. 5 is a functional block diagram of a control module according to the present disclosure.

With reference to FIG. 5, the control module 20 is shown and includes a processor 60 and memory 62. The memory 62 may store control programs 64. For example, the control programs 64 may include programs for execution by the processor 60 to perform the control algorithms for flooded start control described herein. The memory 62 also includes data 66, which may include historical operational data of the compressor 20 and refrigeration systems 10, 30. The data 66 may also include configuration data, such as setpoints and control parameters. For example, the data 66 may include system configuration data and asset data that corresponds or identifies various system components in the refrigeration system 10, 30. For example, the asset data may indicate specific component types, capacities, model numbers, serial numbers, and the like. As described in further detail below, the control module 20 can then reference the system configuration data and asset data during operation as part of the flooded start control. The control module 20 includes inputs 68, which may, for example, be connected to the various sensors described herein. The control module 20 may also include outputs 70 for communicating output signals, such as control signals. For example, the outputs 70 may communicate control signals from the control module 20 to the compressor 12 and the crankcase heater 26. The control module 20 may also include communication ports 72. The communication ports 72 may allow the control module 20 to communicate with other devices, such as a refrigeration system controller, a thermostat, and/or a remote monitoring device. The control module 20 may use the communication ports 72 to communicate through an internet router, Wi-Fi, or a cellular network device to a remote server for sending or receiving data.

Figure 6:
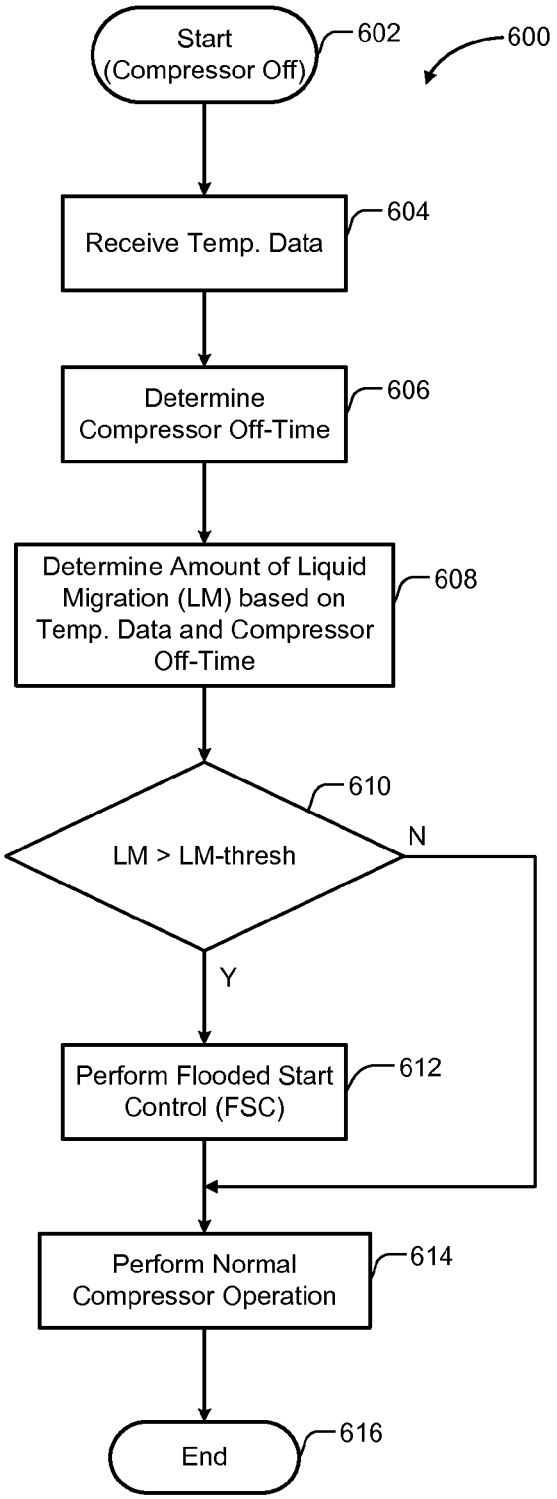
FIG. 6 is a flowchart for a control algorithm according to the present disclosure.

With reference to FIG. 6, a control algorithm 600 for performing flooded start control is shown. The control algorithm 600 may be performed, for example, by the control module 20. Further, the control algorithm 600 may be performed when the compressor 12 is currently off and there has been a request or control command or demand for the compressor to turn on. Additionally or alternatively, flooded start control may be performed when the compressor is off, but there is not a request or control command or demand for the compressor to turn on. The control algorithm 600 starts at 602. At 604, the control module 20 receives temperature data. The temperature data, for example, may be outdoor ambient temperature data from the outdoor ambient temperature sensor 24. Additionally, or alternatively, the temperature data may be compressor temperature data from the compressor temperature sensor 22.

At 606, the control module 20 determines a compressor off-time corresponding to the length of time that the compressor has been off. In other words, the compressor off-time corresponds to the length of time since the compressor was last on. In terms of the compressor contactor 40, the compressor off-time corresponds to the length of time that the compressor contactor 40 has been open.

At 608, based on the temperature data and the compressor off-time, the control module 20 can estimate or determine the amount of liquid migration that has occurred. In other words, based on the temperature data and the compressor off-time, the control module 20 can estimate or determine the amount of liquid present within the compressor 12. In this way, the amount of liquid present in the compressor is calculated as a function of the temperature data and the compressor off-time.

As an example, Table 1 shows the functional relationship between outdoor ambient temperature, compressor off-time, and the amount of liquid present in an exemplary three-ton system capacity rated compressor. In Table 1, the compressor off-time is indicated in hours, the outdoor ambient temperature (OAT) is indicated in degrees Fahrenheit, and the amount of liquid refrigerant present in the compressor is indicated in pounds. In Table 1, and the similar tables that follow below, outdoor ambient temperatures of eighty and sixty degrees Fahrenheit are normally associated with operation of an HVAC system, or a reversible heat pump operating in a cooling mode, while outdoor ambient temperatures of forty and twenty degrees Fahrenheit are normally associated with operation of a heat pump operating in a heating mode.

TABLE 1

| Off- | OAT | | | |
|---|---|---|---|---|
| Time | 80° | 60° | 40° | 20° |
| >2 hrs. | 0.7 lbs. | 0.8 lbs. | 0.9 lbs. | 1.2 lbs. |
| >4 hrs. | 1.4 lbs. | 1.6 lbs. | 1.7 lbs. | 2.0 lbs. |
| >8 hrs. | 2.1 lbs. | 2.3 lbs. | 2.4 lbs. | 2.7 lbs. |

TABLE 1-continued

| Off- | OAT | | | |
|---|---|---|---|---|
| Time | 80° | 60° | 40° | 20° |
| >16 hrs. | 2.8 lbs. | 3.0 lbs. | 3.1 lbs. | 3.4 lbs. |
| >24 hrs. | 3.5 lbs. | 3.7 lbs. | 3.8 lbs. | 4.1 lbs. |

The control module 20 may store a look-up table, similar to Table 1, in memory to determine the amount of liquid in the compressor 12 or the control module 20 may use a function to calculate the amount of liquid in the compressor 12. Also, although Table 1 shows liquid amounts based on outdoor ambient temperature, a similar table could be used based on compressor temperature, for example.

At 610, the control module 20 may compare the amount of liquid in the compressor 12 with a predetermined threshold. The predetermined threshold, for example, may be a percentage of a maximum liquid handling volume of the compressor 12. For example, the exemplary three-ton capacity compressor 12 may have a maximum liquid handling volume of six pounds of liquid refrigerant. The predetermined threshold for the three-ton capacity compressor 12 may be, for example, twenty percent of six pounds or 1.2 pounds.

When the amount of liquid in the compressor 12 is greater than the predetermined threshold, the control module 20 performs flooded start control at 612. As described in further detail below, the flooded start control utilizes one or more on/off cycles to begin operation of the compressor 12 in a flooded state. The number of cycles and the lengths of time for the on and off periods of the cycle may vary depending on the amount of liquid present in the compressor 12. For example, the two right-most columns of Table 2 show the number of cycles and the lengths of time for the on and off periods of each cycle in an example embodiment, utilizing the same liquid amounts from Table 1.

TABLE 2

| OAT/Off-Time | 80° | 60° | 40° | 20° | # of cycles | On/Off periods (seconds) |
|---|---|---|---|---|---|---|
| >2 hrs. | 0.7 lbs. | 0.8 lbs. | 0.9 lbs. | 1.2 lbs. | 0 | — |
| >4 hrs. | 1.4 lbs. | 1.6 lbs. | 1.7 lbs. | 2.0 lbs. | 1 | 1 s on, 5 s off |
| >8 hrs. | 2.1 lbs. | 2.3 lbs. | 2.4 lbs. | 2.7 lbs. | 1 | 1 on, 5 s off |
| >16 hrs. | 2.8 lbs. | 3.0 lbs. | 3.1 lbs. | 3.4 lbs. | 2 | 1 s on, 5 s off, 3 s on, 5 s off |
| >24 hrs. | 3.5 lbs. | 3.7 lbs. | 3.8 lbs. | 4.1 lbs. | 2 | 1 s on, 5 s off, 4 s on, 5 s off |

As shown, in Table 2, when the amount of liquid in the compressor 12 is 1.2 pounds or less, the flooded start control is not performed and there are no on/off cycles. When the amount of liquid in the compressor 12 is between 1.4 pounds and 2.7 pounds, one on/off cycle is performed whereby the compressor 12 is on for one second, then off for five seconds. When the liquid in the compressor 12 is between 2.8 pounds and 3.4 pounds, two on/off cycles are performed whereby for the first cycle the compressor 12 is on for one second and then off for five seconds and for the second cycle the compressor 12 is on for three seconds and then off for five seconds. When the liquid in the compressor 12 is between 3.5 pounds and 4.1 pounds, two on/off cycles are performed whereby for the first cycle the compressor 12 is on for one second and then off for five seconds and for the second cycle the compressor 12 is on for four seconds and then off for five seconds. Determination of the lengths of time of the on/off periods and of the number of cycles and performance of the flooded start control is described further below.

Once the control module 20 performs the flooded start control at 612, the control module 20 proceeds to 614 and performs normal compressor operation, i.e., compressor operation without flooded start control. Additionally, at 610 when the amount of liquid present in the compressor 12 is not greater than the predetermined threshold, the control module 20 proceeds to 614 and performs normal compressor operation. The control algorithm ends at 616.

Figure 7:
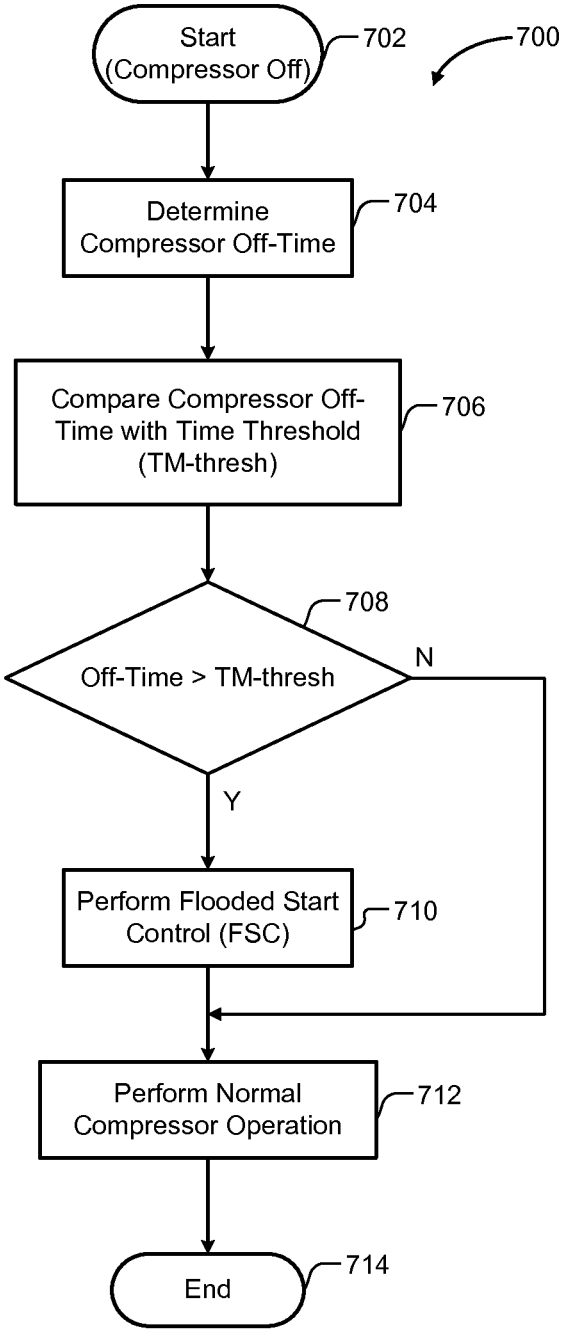
FIG. 7 is a flowchart for another control algorithm according to the present disclosure.

With reference to FIG. 7, another control algorithm 700 for performing flooded start control is shown. The control algorithm 700 may be performed, for example, by the control module 20. Further, the control algorithm 700 may be performed when the compressor 12 is currently off and there has been a request or control command for the compressor 12 to turn on. Additionally or alternatively, flooded start control may be performed when the compressor is off, but there is not a request or control command or demand for the compressor to turn on. The control algorithm 700 starts at 702. At 704, the control module 20 determines the compressor off-time. This determination is described above with respect to 606 of FIG. 6.

At 706, the control module 20 compares the compressor off-time with a predetermined time threshold. For example, the time threshold may be twelve hours. At 708, when the compressor off-time is greater than the predetermined time threshold, the control module 20 proceeds to 710 and performs flooded start control, which is also described above with respect to 612 of FIG. 6. The control module 20 then proceeds to 712 and performs normal compressor operation, i.e., compressor operation without flooded start control. At 708, when the compressor off-time is not greater than the predetermined time threshold, the control module 20 also proceeds to 712 and performs normal compressor operation. The control algorithm 700 ends at 714.

Figure 8:
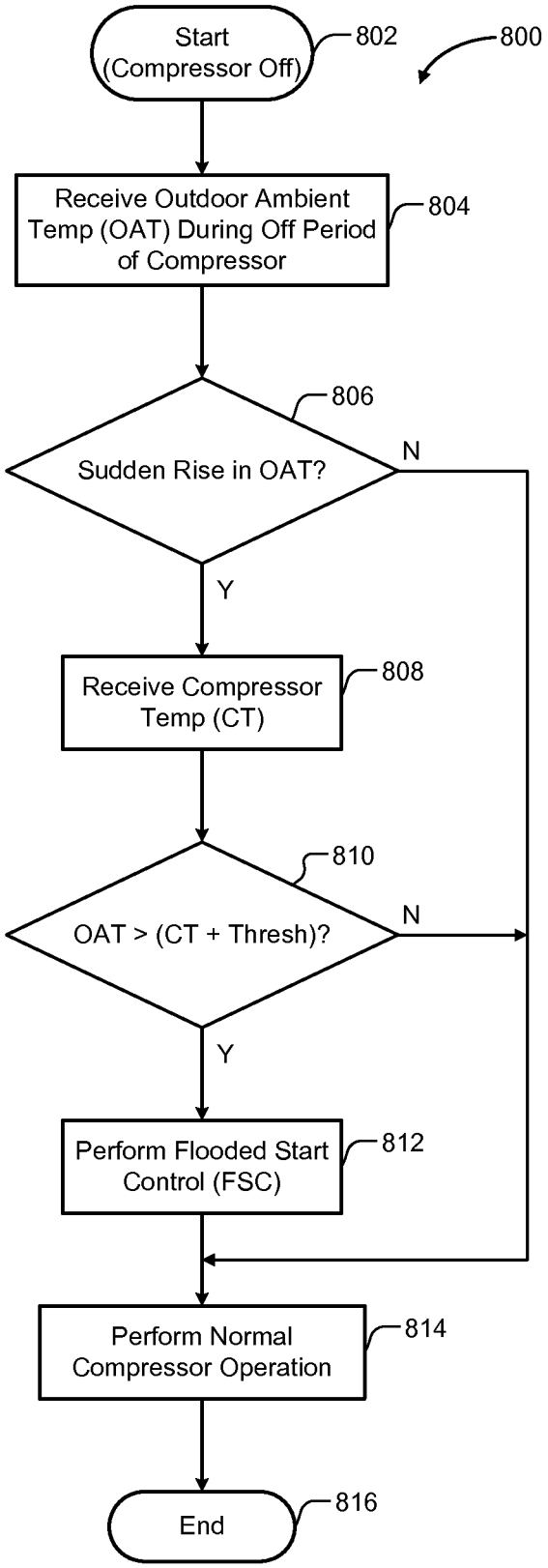
FIG. 8 is a flowchart for another control algorithm according to the present disclosure.

With reference to FIG. 8, another control algorithm 800 for performing flooded start control is shown. The control algorithm 800 may be performed, for example, by the control module 20. Further, the control algorithm 800 may be performed when the compressor 12 is currently off and there has been a request or control command for the compressor 12 to turn on. Additionally or alternatively, flooded start control may be performed when the compressor is off, but there is not a request or control command or demand for the compressor to turn on. The control algorithm 800 starts at 802. At 804, the control module 20 receives the outdoor ambient temperature during an off period of the compressor 12. At 806, the control module 20 determines if there has been a sudden rise in the outdoor ambient temperature. For example, if the outdoor ambient temperature is rising at a rate that is above a predetermined rate threshold, the control module 20 may determine that there is a sudden rise in outdoor ambient temperature. When there is a sudden rise in outdoor ambient temperature, the control module 20 proceeds to 808, otherwise the control module 20 proceeds with performing normal compressor operation at 814, i.e., compressor operation without flooded start control.

At 808, the control module 20 receives the compressor temperature. At 810, the control module 20 determines whether the outdoor ambient temperature is greater than the compressor temperature by a predetermined threshold amount. For example, the predetermined threshold amount may be fifteen degrees Fahrenheit and the control module 20 at 810 may determine whether the outdoor ambient temperature is greater than the compressor temperature by fifteen degrees Fahrenheit or more.

At 810, when the control module 20 determines that the outdoor ambient temperature is greater than the compressor temperature by fifteen degrees Fahrenheit or more, then a sudden liquid migration condition may be present and there may be a high amount of liquid migration into the compressor 12. For example, in an HVAC system, such a condition may occur in the morning after an overnight off period. Overnight, as the outside ambient temperature drops, the indoor temperature of a residence or commercial building associated with the HVAC system may remain higher than the outdoor ambient temperature. As such, liquid refrigerant from components of the HVAC system located within the building will migrate to the colder locations in the components of the HVAC system located outside the building, for example the compressor 12 and the outdoor condenser. Further, in the morning when the sun rises, the outdoor ambient temperature may begin to rise and may rise faster than a temperature of the compressor 12. For example, the compressor 12 may be located near the building in the shade and may not experience direct sunlight. As the outdoor ambient temperature rises quicker than the compressor temperature, additional liquid refrigerant may migrate, at a higher rate, into the compressor 12.

In the case of a sudden liquid migration, the amount of liquid in the compressor 12 may rise above the maximum liquid handling volume. As shown in Table 3, example amounts of liquid present in the compressor 12 are shown for a sudden liquid migration condition associated with different outside ambient temperatures.

TABLE 3

| | OAT | | | |
|---|---|---|---|---|
| | 80° | 60° | 40° | 20° |
| sudden liquid migration | 6.5 lbs. | 6.7 lbs. | 6.8 lbs. | 7.1 lbs. |

At 810, when a sudden liquid migration condition is present, the control module 20 proceeds to 812 and performs flooded start control. Otherwise, the control module 20 proceeds to 814 and performs normal compressor operation, i.e., compressor operation without flooded start control.

At 812, the control module 20 performs flooded start control. As an example, the two right-most columns of Table 4 show the number of cycles and the lengths of time for the on and off periods in an example embodiment, utilizing the same liquid amounts from Table 3.

TABLE 4

| OAT | 80° | 60 | 40 | 20 | # of cycles | On/ Off periods (seconds) |
|---|---|---|---|---|---|---|
| sudden liquid migration | 6.5 lbs. | 6.7 lbs. | 6.8 lbs. | 7.1 lbs. | 2 | 1 s on, 5 s off, 5 s on, 5 s off |

After performing flooded start control at 812, the control module 20 then proceeds to 814 and performs normal compressor operation, i.e., compressor operation without flooded start control.

Figure 9:
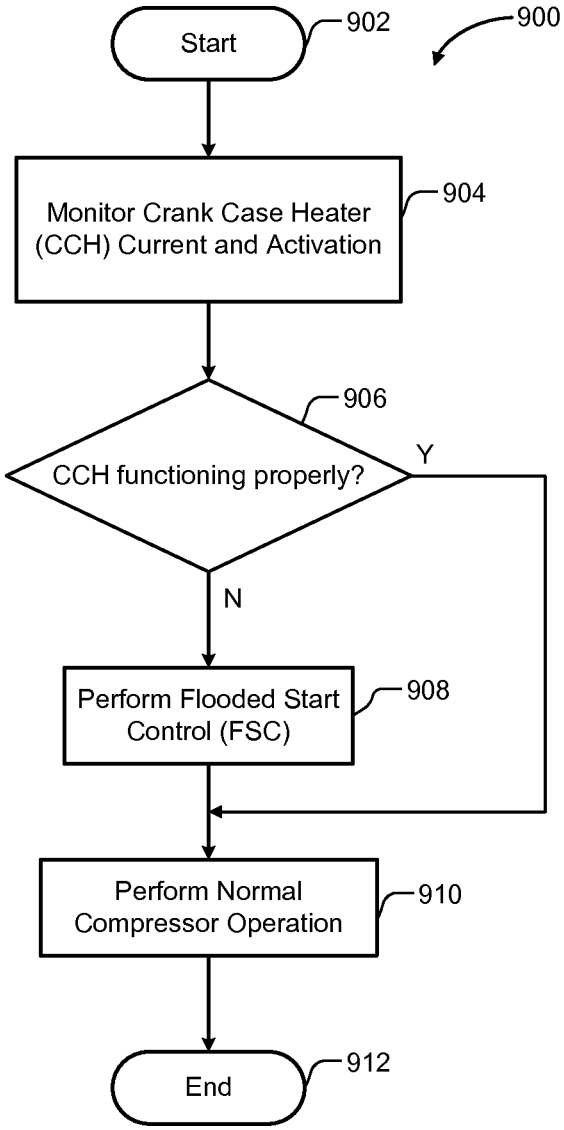
FIG. 9 is a flowchart for another control algorithm according to the present disclosure.

With reference to FIG. 9, a control algorithm 900 for performing flooded start control is shown. The control algorithm 900 may be performed, for example, by the control module 20. Further, the control algorithm 900 may be performed when the compressor 12 is currently off and there has been a request or control command for the compressor 12 to turn on. Additionally or alternatively, flooded start control may be performed when the compressor is off, but there is not a request or control command or demand for the compressor to turn on. Further, the control algorithm 900 may be performed for a compressor 12 that includes a crankcase heater 26. The control algorithm 900 starts at 902. At 904, the control module 20 monitors the crankcase heater current and activation status to determine whether the crankcase heater is functioning properly. For example, the control module 20 may monitor the electrical current of the crankcase heater with a current sensor. Alternatively, a voltage sensor may be used. The control module 20 then proceeds to 906 and determines whether the crankcase heater is functioning properly. For example, if the crankcase heater is currently commanded to be activated and heating, but there is no current flowing to the crankcase heater, then the control module 20 may determine that the crankcase heater is malfunctioning. At 906, when the crankcase heater 26 is not functioning properly, the control module 20 proceeds to 908 and performs flooded start control, as described above with respect to step 612 of FIG. 6, step 710 of FIG. 7, or step 812 of FIG. 8, and as described in further detail below. At 906 when the crankcase heater is functioning properly, the control module 20 proceeds to 910 and performs normal compressor operation, i.e., compressor operation without flooded start control. At 908, after performing flooded start control, the control module 20 proceeds to 910 and performs normal compressor operation. The control algorithm 900 ends at 912.

Figure 10:
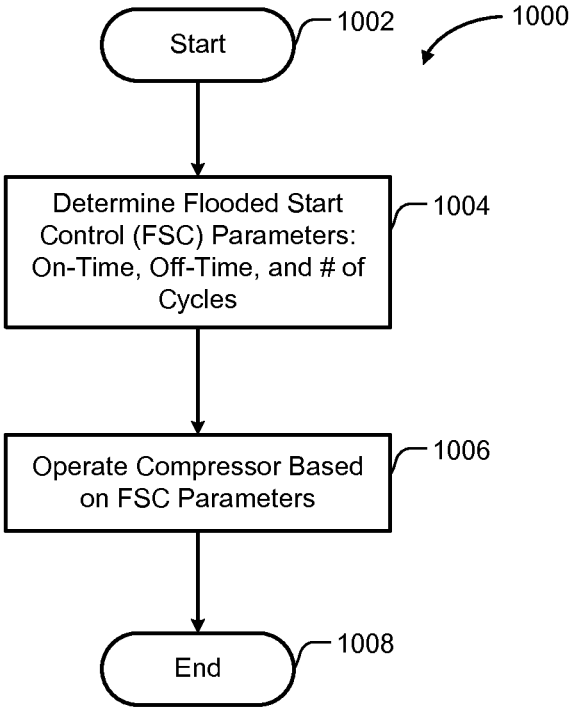
FIG. 10 is a flowchart for another control algorithm according to the present disclosure.

With reference to FIG. 10, a control algorithm 1000 for performing flooded start control is shown. The functionality of the control algorithm 1000 may be encapsulated, for example, in the previous control algorithms that referenced performing flooded start control, including, for example, 612 of FIG. 6, 710 of FIG. 7, 812 of FIG. 8, and 908 of FIG. 9. In other words, control algorithm 1000 may be performed in each of the previous control algorithms when flooded start control is called for, including, specifically, steps 612 of FIG. 6, 710 of FIG. 7, 812 of FIG. 8, and 908 of FIG. 9. The control algorithm 1000 may be performed, for example, by the control module 20. The control algorithm 1000 starts at 1002. At 1004, the control module 20 determines the flooded start control parameters, which include, for example, the on-time, the off-time, and the number of cycles to be performed. These control parameters may be predetermined and stored in the control module 20. Alternatively, some or all of the control parameters may be calculated by the control module 20 during operation, as described below. Examples of the flooded start control parameters are described above with respect to Tables 2 and 4.

At 1006, the control module 20 operates the compressor 12 based on the flooded start control parameters. At 1008, the control algorithm 1000 ends.

Figure 11A:
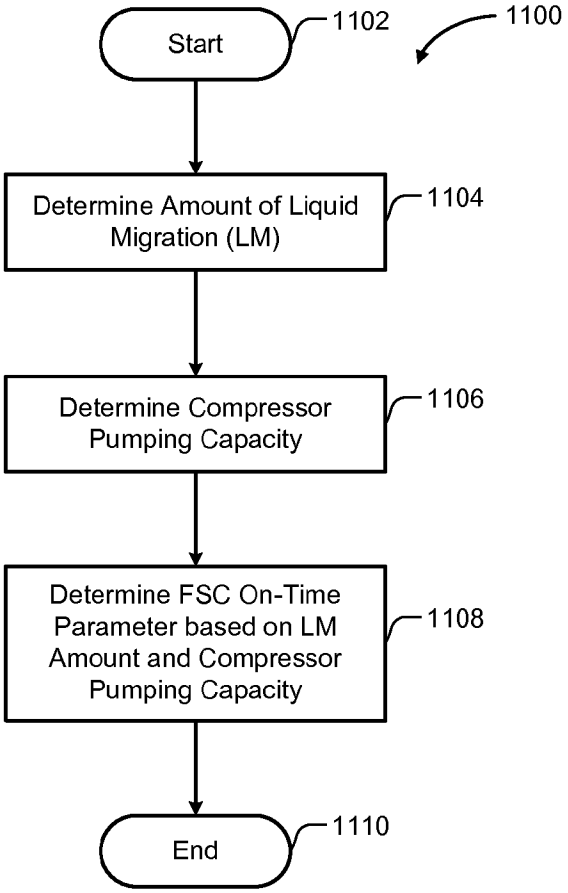
FIG. 11A is a flowchart for another control algorithm according to the present disclosure.
Figure 11B:
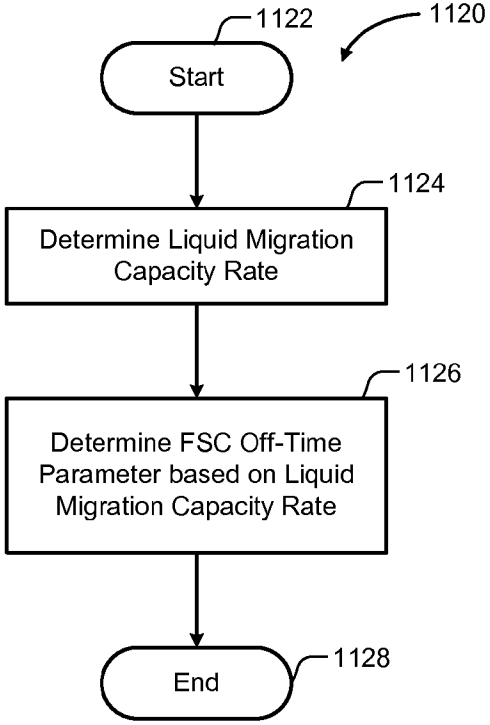
FIG. 11B is a flowchart for another control algorithm according to the present disclosure.
Figure 11C:
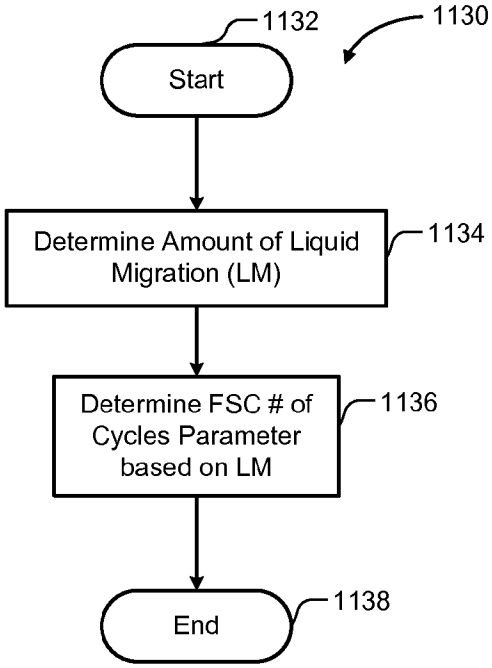
FIG. 11C is a flowchart for another control algorithm according to the present disclosure.

With reference to FIGS. 11A, 11B, and 11C, algorithms 1100, 1120, 1130 for calculating the flooded start control parameters are shown.

Specifically, with reference to FIG. 11A, an algorithm 1100 for calculating the flooded start control on-time parameter is shown and starts at 1102. At 1104, the amount of liquid present in the compressor 12 is determined. This determination may be made, for example, based on outdoor ambient temperature data and compressor off-time data, as described above with respect to 608 of FIG. 6 and with respect to Table 1. At 1106, a compressor pumping capacity, or mass flow, may be determined. As an example, a five ton capacity compressor 12 may pump about one pound of liquid refrigerant per second. For example, at 1106, the control module 20 may access configuration data 66 within memory 62 of control module 20 in order to determine the compressor pumping capacity, or mass flow. At 1108, the flooded start control on-time parameter is calculated based on the determined liquid present in the compressor 12 and the determined compressor pumping capacity. The on-time parameter may be selected to ensure that the total amount of liquid present in the compressor 12 is not pumped out of the compressor 12 during the on-time. For example, if there is three or four pounds of liquid present in the compressor 12, and the pumping capacity is one pound per second, then the on-time parameter may be selected to be two or three seconds to ensure that less than three or four pounds of liquid is pumped out of the compressor 12 when the compressor 12 is operated for the length of the on-time parameter. The algorithm ends at 1110.

With reference to FIG. 11B, an algorithm 1120 for calculating the flooded start control off-time parameter is shown and starts at 1122. At 1124, the liquid migration capacity rate for the refrigeration system 10, 30 is determined. For example, at 1124, the control module 20 may access configuration data 66 within memory 62 of control module 20 in order to determine the liquid migration capacity rate. This rate is generally a function of the type of flow control device used. For example, for a non-bleed type thermal expansion valve (TXV), the migration capacity rate is about one-half pounds of liquid migration per hour. For a fixed orifice flow control device, such as a capillary tube, the rate is much faster at about two pounds per minute. At 1126, the flooded start control off-time parameter is determined based on the liquid migration capacity rate. Specifically, the off-time may preferably be greater than the associated on-time for a given cycle to allow for adequate liquid and lubricant return to the suction side of the compressor 12. Further, for most flow control devices, including the non-bleed type thermal expansion valve (TXV) devices and the orifice/capillary tube devices, an off-time of not less than five seconds may be preferable.

With reference to FIG. 11C, an algorithm 1130 for calculating the flooded start control number of cycles parameter is shown and starts at 1132. At 1134, the amount of liquid present in the compressor 12 is determined. This determination may be made, for example, based on outdoor ambient temperature data and compressor off-time data, as described above with respect to 608 of FIG. 6, with respect to Table 1, and with respect to 1104 of FIG. 11A. At 1136, the number of cycles parameter may be determined based on the amount of liquid present in the compressor 12. For example, if there is five pounds of liquid present in the compressor 12, the number of cycles parameter may be set to two cycles so that the liquid refrigerant is removed over the span of two cycles. The number of cycles parameter may be set in conjunction with setting the on-time parameter, described above with respect to FIG. 11A, so that all of the liquid present in the compressor 12 is not pumped out of the compressor 12 over the span of all cycles of the flooded start control. For example, if there is five pounds of liquid in the compressor 12, the control module 20 may determine that the flooded start control should include two cycles, with on-times of two seconds each, for a total of four seconds of pumping over the span of the two cycles. If the compressor 12 removes one pound of liquid per second, then a total of four pounds of liquid will be removed from the compressor 12 over the two cycles. If the off time parameter is set to five seconds, then a total of four pounds of liquid will be removed from the compressor 12 over the entire span of the flooded start control, the total length of which would be fourteen seconds, i.e., the 14 seconds of flooded start control would include operating the compressor for: 2 seconds on, then 5 seconds off, then 2 seconds on again, then 5 seconds off again, for a total flooded start control time of 14 seconds. During the 14 seconds, the compressor 12 would have been pumping liquid for a total of 4 seconds corresponding to the 2 second on-times at the beginning of each of the two cycles. If the compressor 12 removes one pound of liquid per second, then a total of four pounds of liquid would have been removed over the span of the 14 seconds of flooded start control.

The algorithms 1100, 1120, 1130 for calculating the flooded start control parameters may be done by the control module 20 during operation. Alternatively, the algorithms 1100, 1120, 1130 may be performed ahead of time for many different possible liquid amounts present in the compressor 12. The results of such calculations may be programmed into the control module 20 at installation. Additionally, the algorithms 1100, 1120, 1130 may be performed ahead of time for many different possible combinations of liquid amounts present in the compressor 12, compressor pumping capacities, and liquid migration capacity rates. As such, at installation or at the time of manufacture, the control module 20 may be programmed to access the applicable combination of parameters, or sub-group of parameters, based on the components present in the refrigeration system at installation.

Additionally, the flooded start control parameters may be adaptive such that the on-times and off-times may vary or progress from cycle to cycle. For example, a first cycle may include a one second on-time and a five second off-time. A second cycle may include a two second on-time and a five second off-time. A third cycle may include a three second on-time and a five second off-time. Additionally, the off-time may decrease as the cycles progress. For example, the first cycle may include a five second off-time, while the second cycle may include a four second off-time and the third cycle may include a three second off-time.

Additionally, the flooded start control parameters may be optimized to balance considerations of contactor life and compressor noise, on the one hand, and lubrication of the compressor 12 on the other. For example, additional cycling of the compressor 12 will negatively impact the life of the compressor contactor 40. Further, starting and stopping of the compressor 12 will result in audible changes in compressor operation. In other words, while the compressor 12 may not be very loud, the starting and stopping may be audible and noticeable to a nearby person, whereas continual operation may simply drone into background noise. Further, a nearby person may perceive there to be a problem when hearing the audible starting and stopping of the compressor 12. These considerations can be taken into consideration when determining the flooded start control parameters. With these considerations, it may generally be preferable to have no more than two to three cycles, with a ratio of approximately forty-percent of the cycle for on-time and sixty-percent of the cycle for off-time. As an example, two to three cycles, with an on-time of two seconds and an off-time of five seconds may be preferable.

Additionally, the flooded start control parameters may be adapted to whether the refrigeration system is a heat pump operating in a heating mode. For example, with a heat pump system operating in a heating mode, the number of cycles may be increased by thirty to forty percent or the on-time per cycle may be increased by about thirty to forty percent to accommodate the pumping capacity rate being lower due to the lower evaporator temperatures, as compared with an air conditioning cycle in an HVAC system or a heat pump system operating in a cooling mode.

Figure 12:
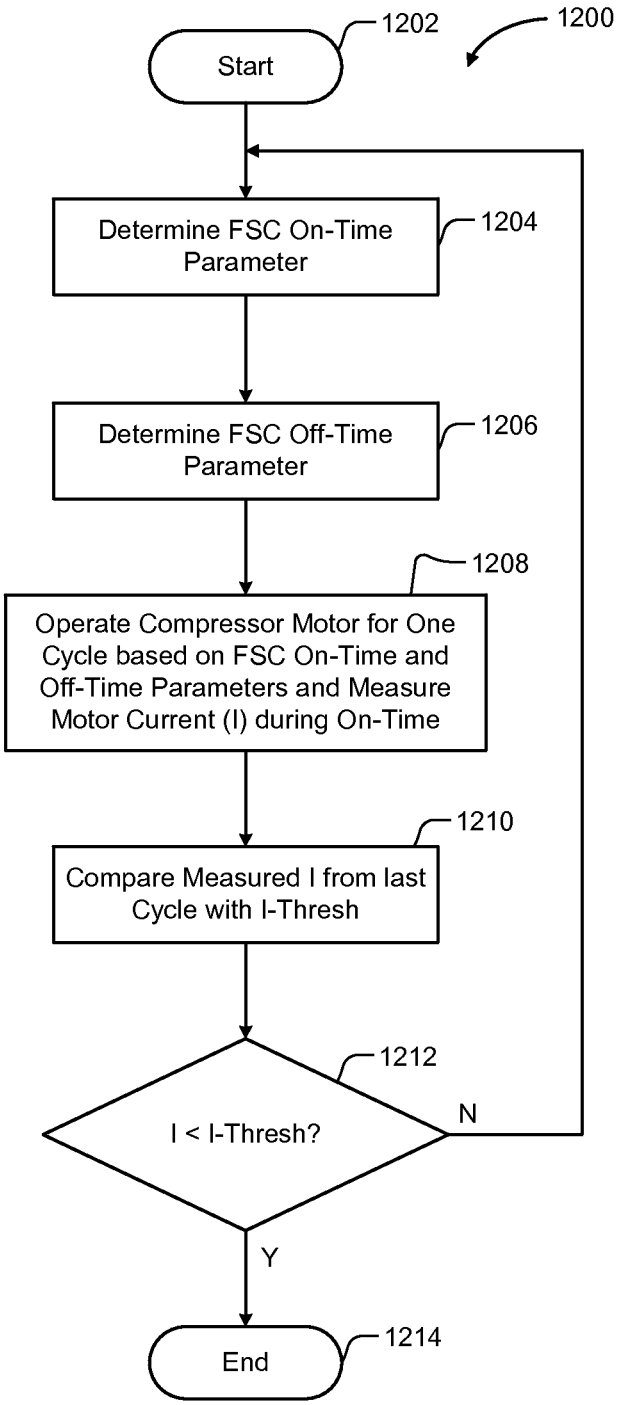
FIG. 12 is a flowchart for another control algorithm according to the present disclosure.

With reference to FIG. 12, another control algorithm 1200 for performing flooded start control is shown. The control algorithm 1200 may be performed, for example, by the control module 20. The functionality of control algorithm 1200 may be encapsulated, for example, in the previous control algorithms that referenced performing flooded start control, including, for example, 612 of FIG. 6, 710 of FIG. 7, 812 of FIG. 8, and 908 of FIG. 9. The control algorithm 1200 starts at 1202. At 1204, the control module 20 determines the flooded start control on-time parameter. This may be determined, for example, as described above with respect to FIG. 11A. At 1206, the control module 20 determines the flooded start off-time parameter. This may be determined, for example, as described above with respect to FIG. 11B.

At 1208, the control module 20 may operate the compressor motor for one cycle based on the determined flooded start control on-time and off-time parameters. Additionally, the control module 20 may measure the electrical current of the compressor 12 during the on-time. At 1210, the control module 20 may compare the measured current from the last cycle with a predetermined current threshold. When the compressor 12 is pumping liquid, the associated electrical current spikes to a level that is higher than when the compressor 12 is only pumping gaseous refrigerant. For example, the electrical current level of a compressor 12 pumping liquid may be 2.5 times greater than the expected electrical current level for the same compressor 12 pumping gaseous refrigerant during normal operation under the same operating and ambient conditions (i.e., after the initial current in-rush in the initial 400 milliseconds time period). As such, the predetermined current threshold at 1210 may be, for example, 1.5 times the level of the normal expected electrical current for the compressor 12 when pumping gaseous refrigerant, under the same operating and ambient conditions.

At 1212, when the measured current is less than the predetermined current threshold, the control algorithm 1200 and cycling ends and no additional flooded start control is performed. At 1212, when the measured current is not less than the predetermined current threshold, the control algorithm 1200 loops back to 1204 and proceeds with another cycle.

Figure 13:
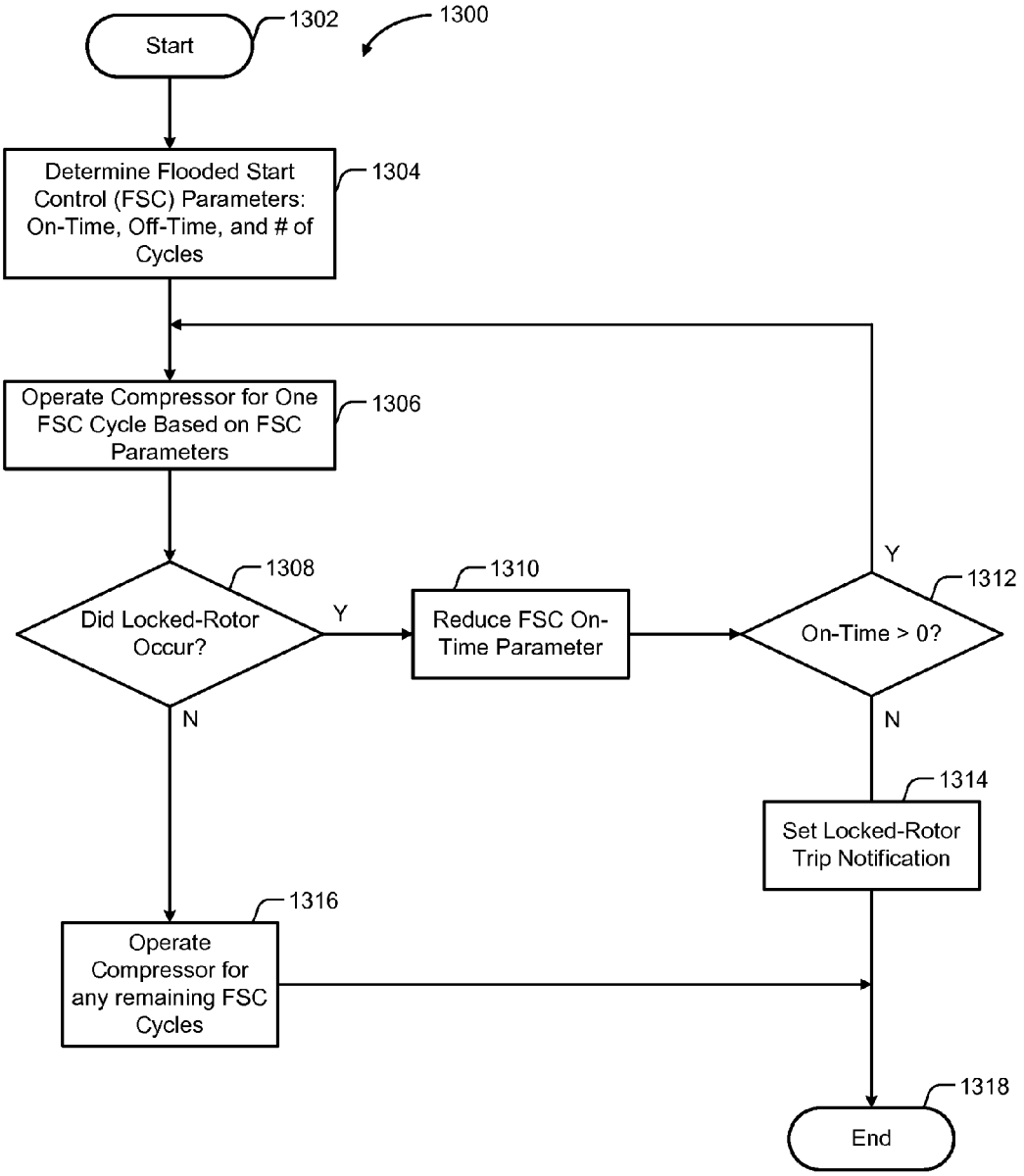
FIG. 13 is a flowchart for another control algorithm according to the present disclosure.

With reference to FIG. 13, another control algorithm 1300 for performing flooded start control is shown. The control algorithm 1200 may be performed, for example, by the control module 20. The control algorithm 1300 starts at 1302. At 1304, the control module 20 determines the flooded start control parameters of on-time, off-time, and number of cycles. These may be determined, for example, as described above with respect to FIGS. 11A, 11B, and 11C.

At 1306, the control module 20 may operate the compressor 12 for one cycle, based on the determined parameters. At 1308, the control module 20 may determine whether a locked rotor condition occurred during the last cycle. For example, during a three-second on-time, a locked-rotor condition may have occurred at the two-second mark due to the compressor 12 pumping liquid instead of gaseous refrigerant. At 1308, when a locked-rotor condition occurred, the control module 20 proceeds to 1310 and reduces the flooded start control on-time parameter. For example, the control module 20 may reduce the on-time parameter by one second at 1310. The control module 20 then proceeds to 1312 and checks to determine whether the adjusted on-time parameter is still greater than zero seconds. When the on-time parameter is still greater than zero seconds, the control module 20 loops back to 1306 and proceeds with the next cycle. At 1312, when the on-time parameter is at or below zero seconds, the control module 20 proceeds to 1314 to set the locked-rotor trip notification and then ends at 1318. At 1308, when a locked-rotor condition did not occur on the last cycle, the control module 20 proceeds to 1316 and operates the compressor 12 for any remaining flooded start control cycles and then ends at 1318. In this way, the control module 20 may adapt the on-time parameter on the fly to avoid a repeated locked rotor condition over successive cycles.

The control module 20 may also measure data associated with a flooded start, without using a flooded start control, to then determine flooded start parameters for use in the future when performing flooded start control. In this way, the control module 20 may initialize and learn characteristics of the refrigeration system 10, 30 that can then be used for flooded start control after initialization.

Figure 14:
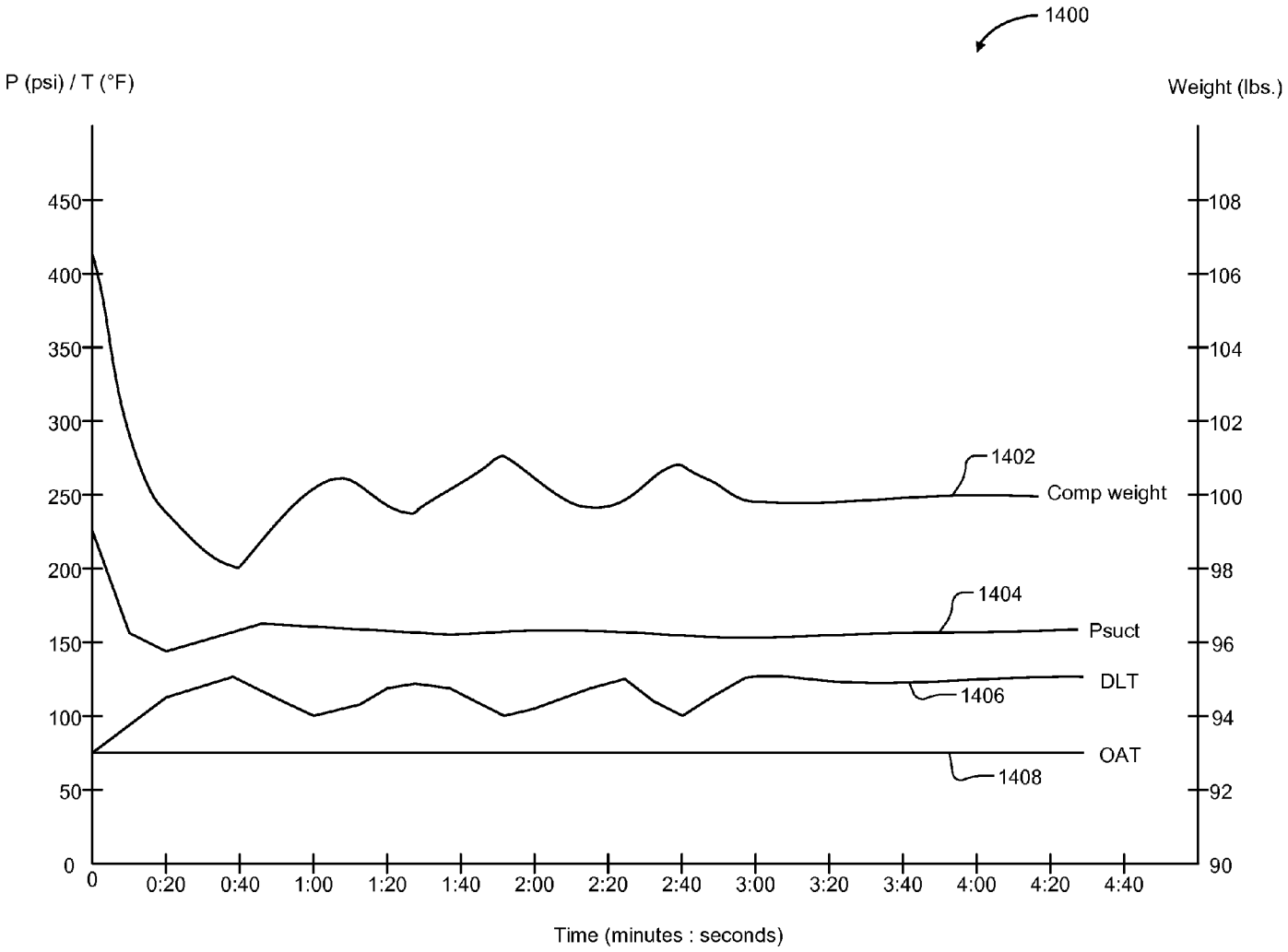
FIG. 14 is a graph illustrating data used for the present disclosure.

For example, the control module 20 may operate the compressor 12 in a flooded start condition, without using the flooded start control algorithms described herein, and may monitor discharge line temperature (DLT). As an example, FIG. 14 shows a graph 1400 of sample data of a three-ton capacity scroll compressor 12, operated in a flooded start condition, with normal control, i.e., without the flooded start control algorithms described here. In FIG. 14, time in minutes and seconds is shown on the bottom horizontal axis, pressure in psi and temperature in degrees Fahrenheit is show on the left vertical axis, and weight in pounds is shown on the right vertical axis. In the graph 1400 of FIG. 14, the compressor weight is shown at 1402, the suction pressure is shown at 1404, the discharge line temperature is shown at 1406, and the outside ambient temperature is shown at 1408.

As shown, about four minutes and forty seconds of data is included in the graph. During that time, the outside ambient temperature graph line 1408 remained steady at about seventy five degrees Fahrenheit.

With respect to the compressor weight graph line 1402, at time zero, the compressor 12 includes about 8.5 pounds of liquid. Within the first ten seconds of normal operation, about 7.0 pounds of liquid has been pumped out of the compressor 12. At about 45 seconds, the entire 8.5 pounds of liquid has been pumped out of the compressor 12 and the compressor 12 is now operating without lubrication and without any liquid inside the compressor 12. At about 45 seconds, the compressor weight graph line 1402 is at its lowest point. At this point, refrigerant and lubricant begin to return to the compressor 12 and the compressor weight begins to increase. After fluctuations over the next 2 to 2.5 minutes, the compressor weight normalizes around the 3:00 minute mark, with about two pounds of liquid in the compressor 12, such liquid being mostly compressor lubricant.

With respect to the suction pressure graph line 1404, the suction pressure is pumped down about 66 psi in the first ten seconds and then drops further in the next ten seconds. The suction pressure then increases somewhat, as refrigerant and lubricant begin to return to the suction side of the compressor 12. After about the forty second mark, the suction pressure begins to normalize.

With respect to the discharge line temperature graph line 1406, like the compressor weight graph line 1402, the discharge line temperature graph line 1406 fluctuates over the first three minutes of operation before normalizing. Further, the discharge line temperature decreases roughly when the compressor weight increases. In other words, the discharge line temperature can be used to estimate the amount of time it takes for the compressor 12 to pump all liquid out of the compressor 12, the amount of time it takes for liquid to begin to return to the compressor 12, and the amount of time it takes for the compressor to normalize to a steady state. The control module 20 can use this data as historical data to learn appropriate flooded start control parameters for future use. For example, based on monitoring the discharge line temperature data, the control module 20 may be able to determine the amount of time it takes for the compressor 12 to completely pump out the liquid contents of the compressor 12 (i.e., about forty-five seconds) and the amount of time it takes for the compressor 12 to normalize operation after a flooded start (i.e., about three minutes). The control module 20 can use this data, for example, to determine that two to three cycles may be required and that the total on-time for all cycles may be less than ten seconds for future flooded start control.

Figure 15A:
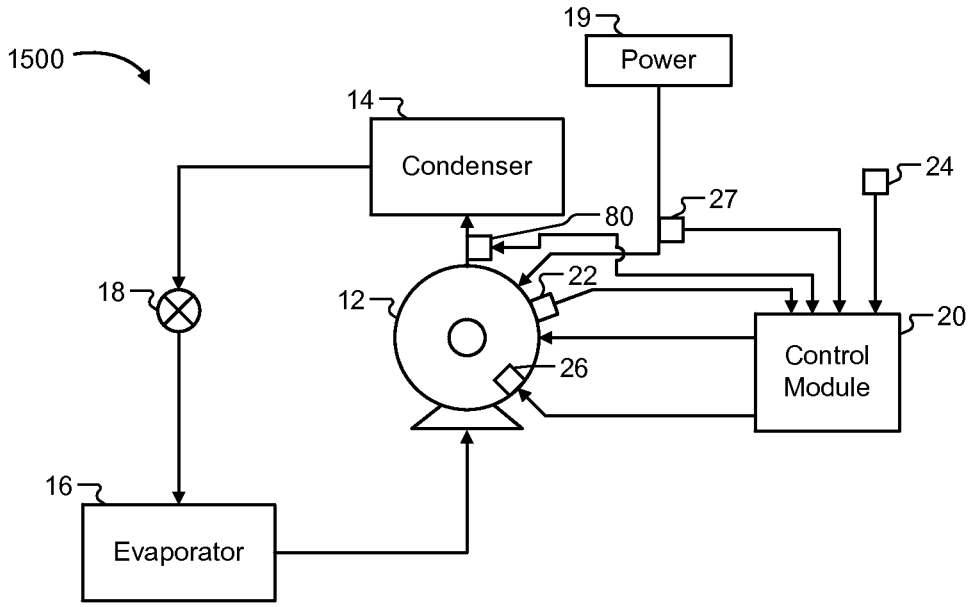
FIG. 15A is a functional block diagram of another example system according to the present disclosure.
Figure 15B:
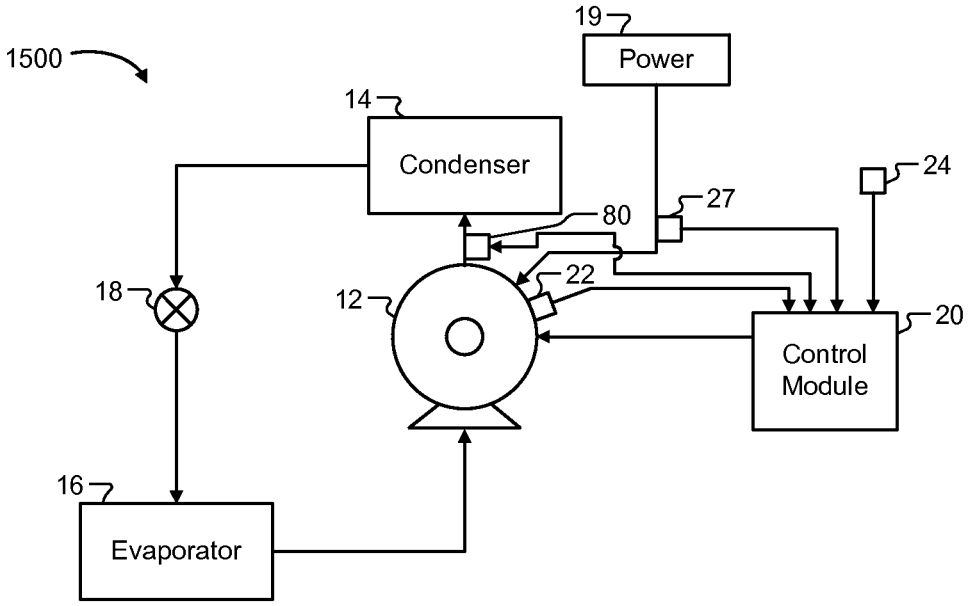
FIG. 15B is a functional block diagram of another example system according to the present disclosure.

With respect to FIG. 15A, a refrigeration system 1500 is shown. The refrigeration system 10 of FIG. 15A is similar to the refrigeration system 10 shown in FIG. 1A, except that the refrigeration system 10 of FIG. 15A includes a discharge line temperature sensor 80 in communication with the control module 20 for sensing the discharge line temperature of the compressor 12, as described above. Similarly, the refrigeration system 1500 of FIG. 15B is similar to the refrigeration system 10 of FIG. 1B, except that the refrigeration system 10 of FIG. 15B likewise includes a discharge line temperature sensor 80.

Figure 16A:
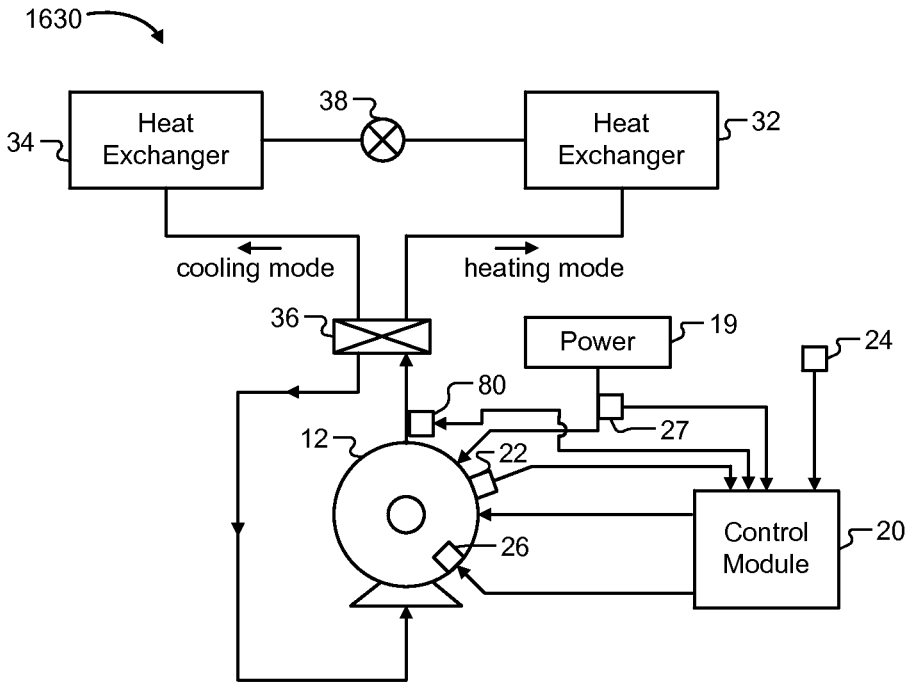
FIG. 16A is a functional block diagram of another example system according to the present disclosure.
Figure 16B:
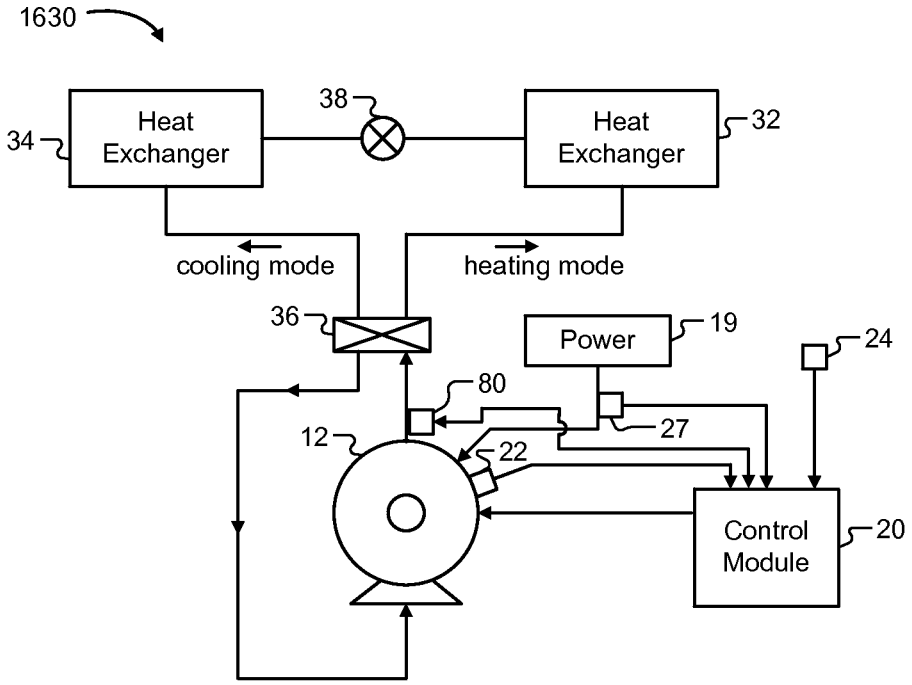
FIG. 16B is a functional block diagram of another example system according to the present disclosure.

With respect to FIG. 16A, a refrigeration system 1630 is shown. The refrigeration system 1630 of FIG. 16A is similar to the refrigeration system 30 shown in FIG. 2A, except that the refrigeration system 1630 of FIG. 16A includes a discharge line temperature sensor 80 in communication with the control module 20 for sensing the discharge line temperature of the compressor 12, as described above. Similarly, the refrigeration system 1630 of FIG. 16B is similar to the refrigeration system 30 of FIG. 2B, except that the refrigeration system 30 of FIG. 16B likewise includes a discharge line temperature sensor 80.

Figure 17:
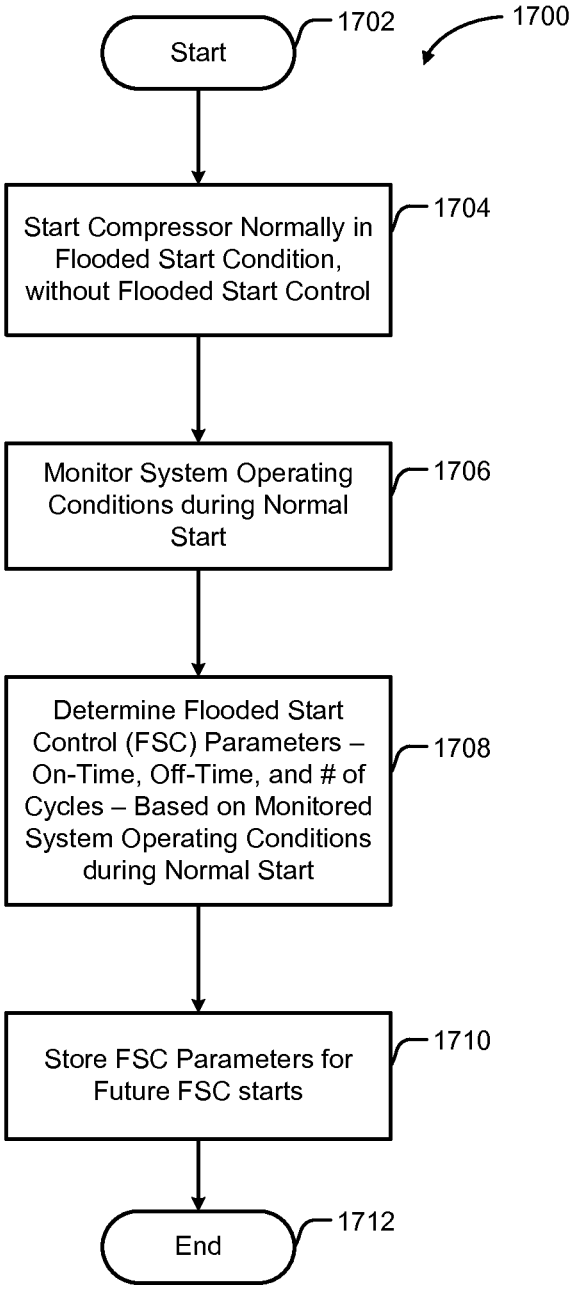
FIG. 17 is a flowchart for another control algorithm according to the present disclosure.

With reference to FIG. 17, a control algorithm 1700 for calculating flooded start control parameters, based on historical data from a normal flooded start, i.e., compressor operation without flooded start control, is shown. The control algorithm 1700 may be performed, for example, by the control module 20. The control algorithm 1700 starts at 1702. At 1704, as discussed above, the control module 20 starts the compressor normally in a flooded start condition without flooded start control. At 1706, the control module 20 monitors operating conditions of the compressor 12 during the normal flooded start. For example, as discussed above, the control module 20 may monitor the discharge line temperature of the compressor 12. Additionally or alternatively, the control module 20 may monitor other operating conditions or parameters of the compressor 12 during the normal flooded start. For example, the control module 20 may monitor compressor current (i.e., the electrical current draw of the compressor), compressor weight (i.e., a total weight of the compressor including the liquid contents of the compressor), and/or compressor temperature. The compressor temperature may include, for example, a compressor shell temperature—including bottom shell and mid-shell temperatures—and/or compressor discharge temperature.

At 1708, based on the monitored system operating conditions during the normal flooded start, the control module 20 determines the flooded start parameters including, for example, the on-time, off-time, and number of cycles parameters. For example, based on the monitored discharge line temperature of the compressor 12, as discussed above with respect to FIG. 14, the control module 20 may determine the amount of time it takes for the compressor 12 to pump all liquid out of the compressor 12, the amount of time it takes for liquid to begin to return to the compressor 12, and the amount of time it takes for the compressor to normalize to a steady state in a normal flooded start condition, without using flooded start control. Based on that data, the control module 20 can choose the flooded start control parameters appropriately to ensure that all liquid in the compressor 12 is not pumped out of the compressor 12 over the entire length of time of the flooded start control. For example, during a normal flooded start condition, compressor 12 may pump all of the liquid out of the compressor 12 in a first time period, which may be, for example, between thirty and sixty seconds. With reference to the example embodiment described above with respect to Table 2, the first time period may be about 45 seconds. As another example, if the first time period is greater than 45 seconds, then the control module 20 may adjust the flooded start parameters to increase the overall compressor on-time during the flooded start control by, for example, increasing the compressor on-time parameter for one or more cycles, increasing the number of cycles parameter, and/or decreasing the compressor off-time parameter for one or more cycles. In this way, the amount of time that the compressor is on during the flooded start control may be increased. As another example, if the first time period is less than 45 seconds, then the control module 20 may adjust the flooded start parameters to decrease the overall compressor on-time during the flooded start control by, for example, decreasing the compressor on-time parameter of one or more cycles, decreasing the number of cycles parameter, and/or increasing the compressor off-time parameter for one or more cycles. The first time period required for the compressor 12 to pump all of the liquid out of the compressor 12 during a normal flooded start condition may be dependent on the size or type of the system 10, (for example, a residential system, a commercial system, etc.) and on the type of flow control device 18 (for example, electronic expansion valve, thermal expansion valve, orifice, etc.). At 1710, the control module 20 stores the flooded start control parameters in memory for future use in performing flooded start control. Additionally, control algorithm 1700 may be re-run to recalibrate the flooded start control parameters at predetermined time intervals or after certain predetermined events occur. In this way, the flooded start control parameters can be updated periodically or after the occurrence of certain predetermined events in order to ensure that the flooded start control parameters are appropriate in light of the time it takes to for the compressor 12 to pump all of the liquid out of the compressor 12 during a normal flooded start condition. For example, the control algorithm 1700 may be re-run monthly, annually, or biannually. In particular, the control algorithm 1700 may be re-run when switching between heating and cooling modes or seasons (particularly for heat pumps). For further example, the control algorithm 1700 may be re-run after certain predetermined events occur, such as at the time of installation, following a repair of the system, and/or following a reset operation of the system.

In addition to the various data described above used to calculate flooded start control parameters, other sensors and data can be used in addition to, or in place of, the above described sensors and data. For example, the optimum flooded start control parameters may be determined based on suction pressure sensed by a suction pressure sensor, suction temperature sensed by a suction temperature sensor, discharge line pressure sensed by a discharge line pressure sensor, discharge line temperature sensed by a discharge line temperature sensor, mass flow sensed by a mass flow sensor, oil level sensed by an oil level sensor, liquid level sensed by a liquid level sensor, bottom shell temperature sensed by a bottom shell temperature sensor, motor temperature sensed by a motor temperature sensor, and any other temperature, pressure, or other data or parameters related to the amount of liquid present in the compressor 12.

As discussed above, the flooded start control may be used in conjunction with a crankcase heater 26. For example, a crankcase heater 26 may be suitable for slow liquid migration conditions, while the flooded start control described herein may be reserved for fast liquid migration conditions.

Figure 18:
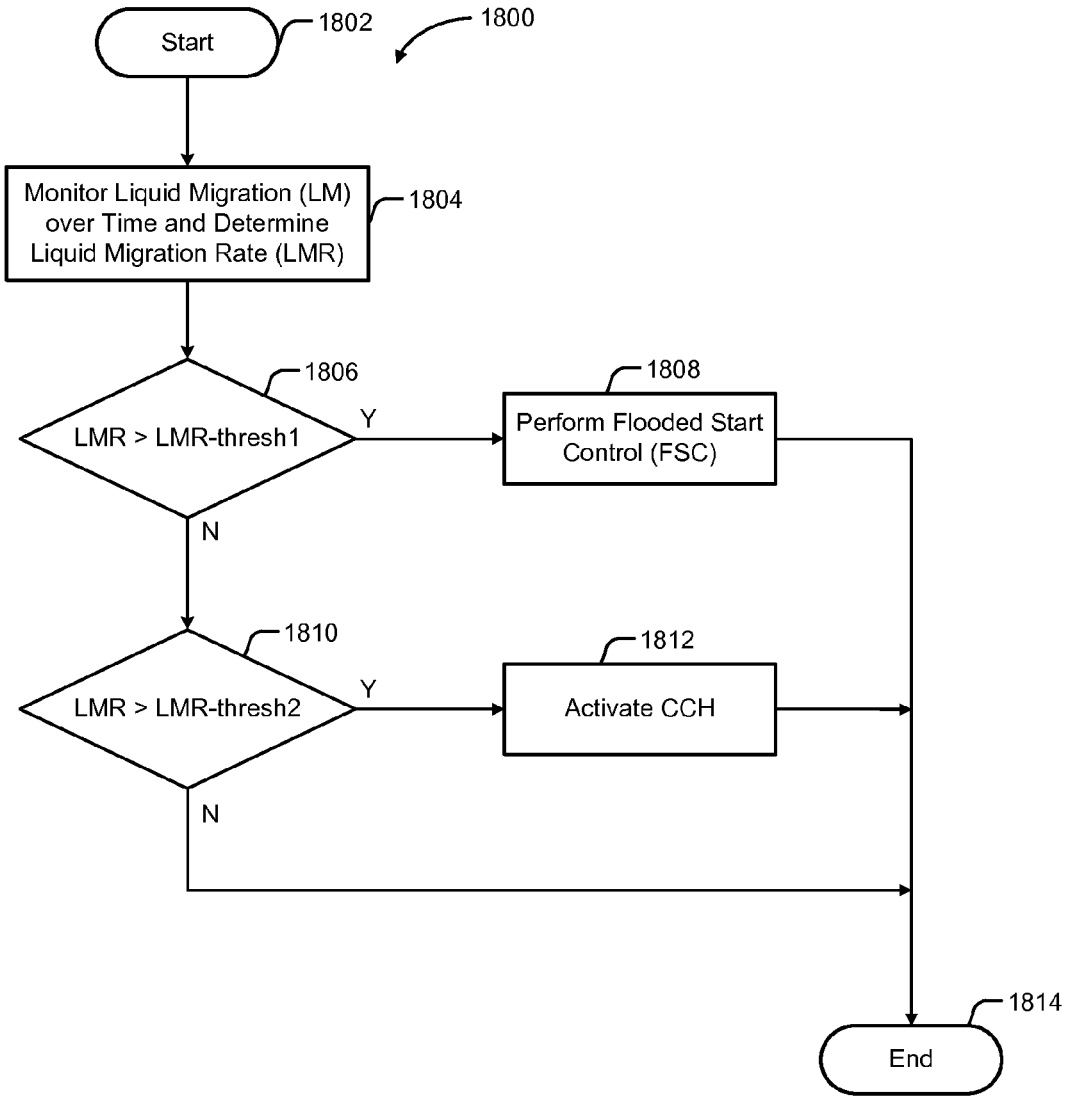
FIG. 18 is a flowchart for another control algorithm according to the present disclosure.

With reference to FIG. 18, a control algorithm 1800 for using flooded start control together with a crankcase heater 26 is shown. The control algorithm 1800 may be performed, for example, by the control module 20. The control algorithm 1800 starts at 1802. At 1804, the control module 20 monitors liquid migration over time by monitoring the amount of liquid present in the compressor 12. The control module 20 determines a current liquid migration rate (LMR). For example, the control module 20 may determine the level of liquid present in the compressor 12, as discussed above with respect to steps 604, 606, and 608 of FIG. 6, for example. Further, the control module 20 may monitor the level of liquid present in the compressor 12 over time to determine the current liquid migration rate (LMR). In other words, the current liquid migration rate (LMR) corresponds to the rate at which liquid is migrating into the compressor, based on determined liquid levels present in the compressor over time. At 1806, the control module 20 compares the liquid migration rate with a first liquid migration rate threshold. At 1806, when the liquid migration rate is greater than the liquid migration rate threshold, a fast liquid migration condition is present and the control module 20 proceeds to 1808 to perform flooded start control and then to 1814 to end.

At 1806, when the liquid migration rate is not greater than the first liquid migration rate threshold, the control module 20 compares the liquid migration rate with a second liquid migration rate threshold at 1810. The second liquid migration rate threshold is less than the first liquid migration rate threshold. When the liquid migration rate is greater than the second liquid migration rate threshold, but less than the first liquid migration rate threshold, a slow liquid migration condition is present and the control module 20 proceeds to 1812 to activate the crankcase heater and then to 1814 to end.

Figure 19:
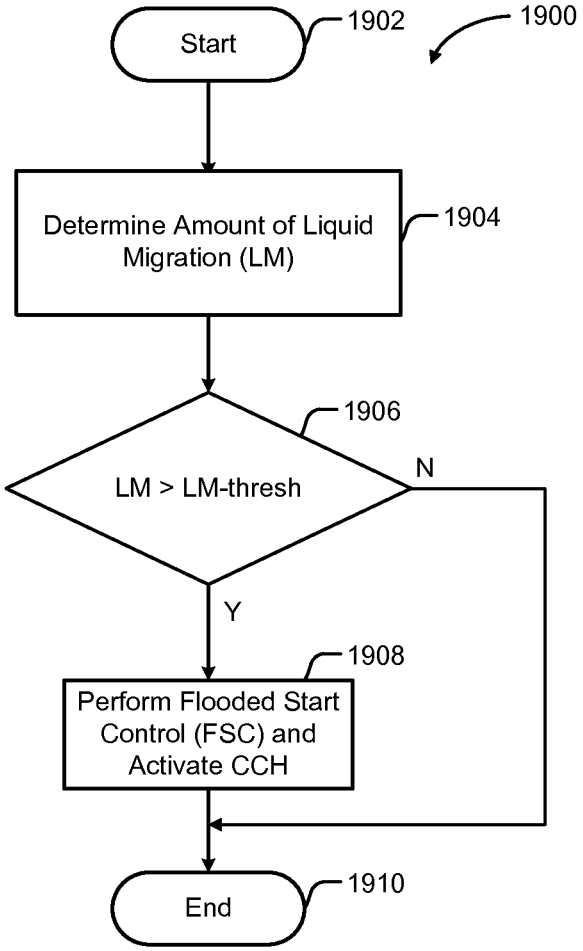
FIG. 19 is a flowchart for another control algorithm according to the present disclosure.

With reference to FIG. 19, another control algorithm 1900 for using flooded start control together with a crankcase heater 26 is shown. The control algorithm 1900 may be performed, for example, by the control module 20. The control algorithm 1900 starts at 1902. At 1904, the control module 20 determines the amount of liquid present in the compressor 12, as described in detail above. At 1906, the control module 20 compares the amount of liquid present in the compressor 12 with a predetermined threshold. When the amount of liquid present in the compressor 12 is greater than the predetermined threshold, the control module 20 proceeds to 1908 and performs flooded start control in conjunction with activating the crankcase heater 26 and then to 1910 to end. At 1906, when the amount of liquid present in the compressor 12 is not greater than the predetermined threshold, the control module 20 proceeds to 1910 and ends.

In this way, when the compressor 12 is completely filled with liquid, both the flooded start control and the crankcase heater are used together. Additionally, the control module 20 may determine that the compressor 12 is completely filled with liquid based on a current spike, i.e., a substantial increase in the amount of current flowing to the compressor 12. For example, the current spike may be 2.5 times the normal expected amount of current flowing to the compressor 12 in normal operation under the same operating and ambient conditions (i.e., after the initial current in-rush in the initial 400 milliseconds time period). Additionally, the control module 20 may determine that the compressor 12 is completely filled with liquid based on a locked rotor condition. In each of these additional cases, the control module 20 may then use the flooded start control together with activating of the crankcase heater.

Figure 20:
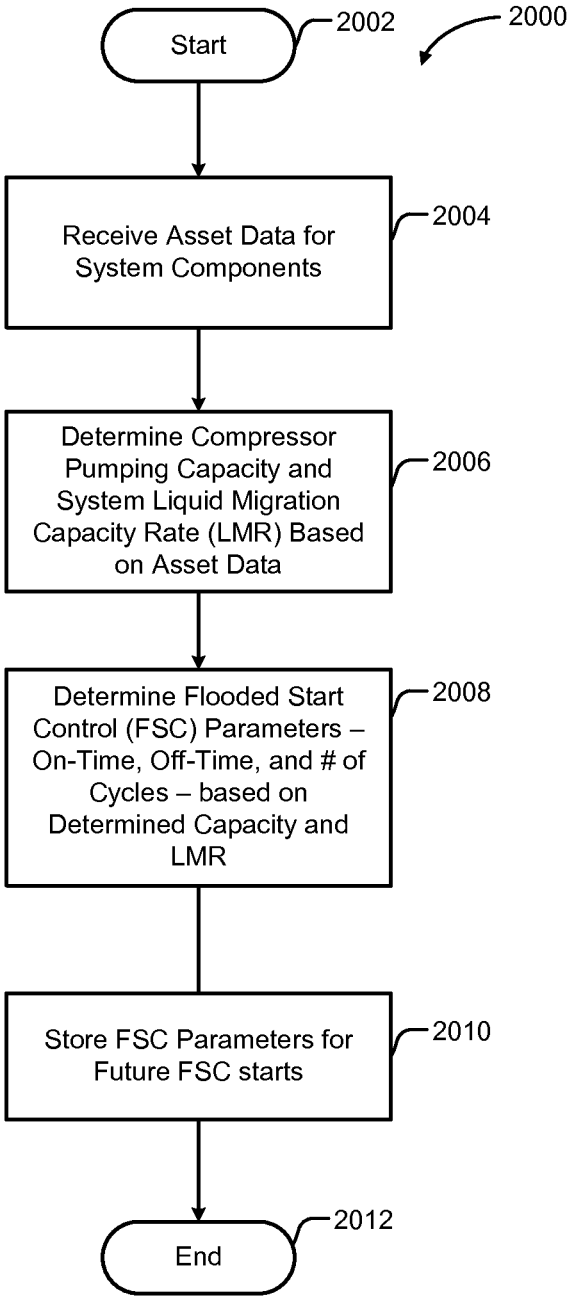
FIG. 20 is a flowchart for another control algorithm according to the present disclosure.

With reference to FIG. 20, a control algorithm 2000 for discovering asset data for system components of the refrigeration system 10, 30 is shown. The control algorithm 2000 may be performed, for example, by the control module 20. The control algorithm 2000 starts at 2002. At 2004, the control module 20 receives asset data for system components of the refrigeration system 10, 30. The control module 20 may communicate with other equipment or controllers present in the system to determine the asset data. Additionally, the control module 20 may communicate with a thermostat associated with the refrigeration system 10, 30 or a refrigeration system controller present in the refrigeration system 10, 30. Additionally, the control module 20 may communicate with a remote monitoring device or server to receive asset data. Additionally, the control module 20 may receive the asset data from user input to the control module 20 or user input to another computing device, such as a remote computing device, that is then communicated to the control module 20.

The received asset data may include information related to various system component types and capacities. For example, the asset data may indicate the type of flow control device present in the refrigeration system 10, 30, the type of condenser or evaporator present in the refrigeration system 10, 30, whether the compressor 12 is a variable capacity compressor or a multi-stage compressor, or whether multiple compressors are present in the refrigeration system 10, 30. Additionally, for example, the asset data may indicate the type of compressor such as a high-side scroll compressor (i.e., motor is located in a discharge pressure zone of the compressor 12), a low-side scroll compressor (i.e., motor is located in a suction pressure zone of the compressor 12), a directed suction low-side scroll compressor (i.e., suction inlet 52 is connected, directly or loosely, to the scroll set 50 inlet of the compressor 12), a high-side rotary compressor, or a low-side rotary compressor.

In the case of a multi-stage compressor, since the flooded start control depends on the pumping rate of the system, it is preferable to apply the flooded start control in a lower capacity stage. In the case of multiple compressors, it is preferable to apply the flooded start control to one of the multiple compressors.

At 2006, the control module 20 determines compressor pumping capacity and system liquid migration capacity rates based on the received asset data. At 2008, the control module 20 determines the flooded start control parameters, including on-time, off-time, and number of cycles, based on the determined pumping capacity and determined liquid migration capacity rate. At 2010, the control module 20 stores the flooded start operating parameters for use with flooded start control in the future. At 2012, the control module 20 ends.

Additionally, the asset data discussed above may indicate that the compressor 12 is a directed suction type compressor. In such case, the flooded start control parameters may be adjusted to account for the different pumping rates associated with a direct suction type compressor. Specifically, with a directed suction type compressor, the pumping rate is significantly lower by a factor proportional to the ratio of the scroll volume to the compressor shell volume. As such, with a direct suction type compressor, the flooded start control on-time parameter may need to increase by a factor of five to ten times, as compared with a non-direct suction type compressor. Alternatively, the control module 20 may be configured not to perform flooded start control when a direct suction type compressor is discovered as part of the asset data.

During operation of a standard low-side compressor 12, the liquid inside the compressor 12 is taken from the interior of the compressor 12, through the suction intake of the scroll set 50, through the discharge of the scroll set 50, and out through a discharge outlet 90 of the compressor 12. In contrast, for a directed suction type compressor 12 the suction inlet 52 is connected directly or loosely to the suction intake 85 of the scroll set 50. In such case, liquid enters the compressor 12 through the suction inlet 52 and then enters the scroll set 50. The liquid then seeps into the interior of the compressor 12 through the scroll set 50. During operation of the directed suction type compressor 12, liquid is taken both from the suction inlet 52 and the interior of the compressor 12. For a directed suction type compressor, however, the pressure within the suction inlet 52 will decrease faster than the pressure within the remainder of the interior of the suction chamber of the compressor 12. Further, liquid from inside the compressor 12 will seep back into the scroll set 50 for pumping out of the compressor 12 through the discharge outlet 90.

When utilizing the flooded start control of the present disclosure with a directed suction type compressor 12, these different pumping rates, resulting from the configuration of the direction suction type compressor, can be taken into account.

The foregoing description is merely illustrative in nature and is in no way intended to limit the disclosure, its application, or uses. Individual elements or features of a particular embodiment are generally not limited to that particular embodiment, but, where applicable, are interchangeable and can be used in another embodiment, even if not specifically shown or described. The same may also be varied in many ways. Such variations are not to be regarded as a departure from the disclosure, and all such modifications are intended to be included within the scope of the disclosure. Therefore, while this disclosure includes particular examples, the scope of the disclosure should not be so limited since other modifications will become apparent upon a study of the drawings, the specification, and the claims.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules.

The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a compressor for a refrigeration system;

a temperature sensor that generates temperature data corresponding to at least one of a compressor temperature and an ambient temperature;

a control module that receives the temperature data, determines an off-time period since the compressor was last on, determines an amount of liquid present in the compressor based on the temperature data and the off-time period, compares the amount of liquid with a predetermined threshold, and, when the amount of liquid is greater than the predetermined threshold, operates the compressor according to at least one cycle including a first time period during which the compressor is on and a second time period during which the compressor is off;

wherein the control module determines a pumping capacity of the compressor and determines the first time period of the at least one cycle based on the amount of liquid and the pumping capacity, such that the amount of liquid is not pumped out of the compressor during the at least one cycle.

2. The system of claim 1 wherein liquid remains in the compressor throughout the at least one cycle.

3. The system of claim 1 wherein the liquid includes both lubricant and refrigerant.

4. The system of claim 1, wherein the first time period is two seconds and the second time period is five seconds.

5. The system of claim 1, wherein the at least one cycle includes a first cycle and a second cycle and wherein the first time period of the first cycle is less than the first time period of the second cycle.

6. The system of claim 1, wherein the control module operates the compressor normally after the at least one cycle.

7. The system of claim 1, wherein the control module determines a liquid migration capacity rate for the refrigeration system and determines the second time period of the at least one cycle based on the liquid migration capacity rate.

8. The system of claim 7, wherein the second time period is determined such that refrigerant is returned to a suction side of the compressor by the end of the second time period of a last cycle of the at least one cycle.

9. The system of claim 1, wherein the control module determines a number of cycles for the at least one cycle based on the amount of liquid.

10. The system of claim 1 wherein the temperature sensor generates temperature data corresponding to a compressor temperature, the system further comprising an additional temperature sensor that generates temperature data corresponding to an ambient temperature, wherein the control module determines the amount of liquid present in the compressor based on the compressor temperature and the ambient temperature.

11. A method comprising:

generating temperature data with a temperature sensor, the temperature data corresponding to at least one of a compressor temperature and an ambient temperature;

receiving the temperature data with a control module;

determining, with the control module, an off-time period since the compressor was last on;

determining, with the control module, an amount of liquid present in the compressor based on the temperature data and the off-time period;

comparing, with the control module, the amount of liquid with a predetermined threshold;

operating, with the control module, the compressor according to at least one cycle including a first time period during which the compressor is on and a second time period during which the compressor is off when the amount of liquid is greater than the predetermined threshold;

wherein the control module determines a pumping capacity of the compressor and determines the first time period of the at least one cycle based on the amount of liquid and the pumping capacity, such that the amount of liquid is not pumped out of the compressor during the at least one cycle.

12. The method of claim 11 wherein liquid remains in the compressor throughout the at least one cycle.

13. The method of claim 11 wherein the liquid includes both lubricant and refrigerant.

14. The method of claim 11, wherein the first time period is two seconds and the second time period is five seconds.

15. The method of claim 11, wherein the at least one cycle includes a first cycle and a second cycle and wherein the first time period of the first cycle is less than the first time period of the second cycle.

16. The method of claim 11, further comprising operating, with the control module, the compressor normally after the at least one cycle.

17. The method of claim 11, further comprising determining, with the control module, a liquid migration capacity rate for the refrigeration system and determining, with the control module, the second time period of the at least one cycle based on the liquid migration capacity rate.

18. The method of claim 17, wherein the second time period is determined such that refrigerant is returned to a suction side of the compressor by the end of the second time period of a last cycle of the at least one cycle.

19. The method of claim 11, further comprising determining, with the control module, a number of cycles for the at least one cycle based on the amount of liquid.

20. The method of claim 11 wherein the temperature sensor generates temperature data corresponding to a compressor temperature, the system further comprising an additional temperature sensor that generates temperature data corresponding to an ambient temperature, the method further comprising determining, with the control module, the amount of liquid present in the compressor based on the compressor temperature and the ambient temperature.

* * * * *